US010766505B2

(12) United States Patent
Veit et al.

(10) Patent No.: US 10,766,505 B2
(45) Date of Patent: Sep. 8, 2020

(54) RAILROAD CAR AND END DOOR ASSEMBLY THEREFOR

(71) Applicant: NATIONAL STEEL CAR LIMITED, Hamilton (CA)

(72) Inventors: Oliver M. Veit, Hamilton (CA); Kenneth Wayne Black, Hamilton (CA); James W. Forbes, Campbellville (CA); Mark Anthony Suffoletta, Stoney Creek (CA); James Batchelor, Burlington (CA)

(73) Assignee: National Steel Car Limited, Ontario (CA)

( * ) Notice: Subject to any disclaimer, the term of this patent is extended or adjusted under 35 U.S.C. 154(b) by 625 days.

(21) Appl. No.: 15/403,747

(22) Filed: Jan. 11, 2017

(65) Prior Publication Data

US 2018/0194373 A1 Jul. 12, 2018

(51) Int. Cl.

| | |
|---|---|
| ***B61D 19/00*** | (2006.01) |
| ***B61D 3/00*** | (2006.01) |
| ***B61D 39/00*** | (2006.01) |
| ***B61D 17/06*** | (2006.01) |
| ***B61D 7/18*** | (2006.01) |

(52) U.S. Cl.

CPC ..... *B61D 19/004* (2013.01); *B61D 3/00* (2013.01); *B61D 7/18* (2013.01); *B61D 17/06* (2013.01); *B61D 19/001* (2013.01); *B61D 39/00* (2013.01)

(58) Field of Classification Search

CPC ..... B61D 19/004; B61D 19/001; B61D 7/18; B61D 9/00; B61D 9/06; B61D 17/00; B61D 17/06

USPC ..... 105/258, 261.2, 406.1, 406.2

See application file for complete search history.

(56) References Cited

U.S. PATENT DOCUMENTS

| | | | |
|---|---|---|---|
| 1,363,195 | A | 12/1920 | Hosceit |
| 1,375,027 | A | 4/1921 | Thompson |
| 1,398,375 | A | 11/1921 | Hart |
| 1,433,270 | A | 10/1922 | Gilpin |
| 1,461,201 | A | 7/1923 | Van Dorn |
| 1,881,451 | A | 10/1932 | Franck |
| 1,910,583 | A | 5/1933 | Wine |
| 1,937,540 | A | 12/1933 | Abel |
| 2,218,441 | A | 10/1940 | Thompson |

(Continued)

FOREIGN PATENT DOCUMENTS

| | | |
|---|---|---|
| AU | 1441992 A | 9/1992 |
| CA | 2100146 | 11/1998 |

(Continued)

*Primary Examiner* — Zachary L Kuhfuss

(74) *Attorney, Agent, or Firm* — Hahn Loeser & Parks LLP

(57) ABSTRACT

A gondola car has a door and an associated door frame the end. The door hangs hingedly from the header of the frame. The header runs across the top of the door opening and is connected to the top chords at either side. The door posts are positioned inside the side sheets and tie into the header at each upper corner. The side sheets lap onto the door posts to allow longitudinal adjustment of the side assemblies and the door frame relative to each other, at assembly. The side posts are connected to the header with a tie plate that is bolted to both members. The car may also have a tarp dome at each end. The tarp dome has non-welded connections that have play to permit the tarp dome to accommodate movement of the top chords.

26 Claims, 21 Drawing Sheets

(56) References Cited

U.S. PATENT DOCUMENTS

| | | | | |
|---|---|---|---|---|
| 2,674,208 | A | 4/1954 | Keller et al. | |
| 2,985,118 | A | 5/1961 | Maharick et al. | |
| 3,327,649 | A | 6/1967 | Fisher et al. | |
| 3,461,818 | A | 8/1969 | Sanders et al. | |
| 3,831,792 | A | 8/1974 | Waterman et al. | |
| 4,013,018 | A | 3/1977 | Hansen et al. | |
| 4,646,653 | A | 3/1987 | Balbi et al. | |
| 4,893,568 | A * | 1/1990 | Adams | B61D 3/005 105/248 |
| 5,054,402 | A | 10/1991 | Brassell | |
| 5,181,474 | A * | 1/1993 | Miller | B61D 17/04 105/355 |
| 6,220,178 | B1 * | 4/2001 | Jost | B60J 5/0498 105/258 |
| 6,250,233 | B1 | 6/2001 | Luckring | |
| 7,594,474 | B2 | 9/2009 | Zupancich | |
| 7,784,411 | B2 | 8/2010 | Forbes | |
| 7,878,125 | B2 | 2/2011 | Forbes et al. | |
| 8,141,726 | B2 | 3/2012 | Forbes et al. | |
| 2007/0101895 | A1 * | 5/2007 | Forbes | B61D 17/00 105/406.1 |
| 2007/0277696 | A1 * | 12/2007 | Forbes | B61D 9/00 105/406.1 |

FOREIGN PATENT DOCUMENTS

| | | | |
|---|---|---|---|
| CA | 2332760 | A1 | 7/2001 |
| CA | 2590986 | C | 7/2001 |
| CA | 2678447 | A1 | 3/2011 |
| CA | 2678605 | C | 3/2011 |

* cited by examiner

RAILROAD CAR AND END DOOR ASSEMBLY THEREFOR

FIELD OF THE INVENTION

This invention relates to the field of railroad freight cars, and, in particular to the field of railroad freight cars that unload at one end or both ends.

BACKGROUND

Some railroad freight cars disgorge their lading through the end wall of the car. For example, a particular kind of open top gondola car is used for carrying such types of lading as woodchips or cottonseeds. Such lading may tend to inter-lock and hold itself together, rather than to fall easily as might a more granular form of lading. Were a bottom discharge car used, the lading might have a tendency to hang-up. It may be easier to dislodge low-density interlocking lading with a vehicle, such as a tractor or front end loader, or end dump, like a woodchip car. For such a car to be both open top and side-opening, in the manner of a box car, is structurally problematic. Having an end wall discharge, rather than a sidewall discharge, may tend to permit such a car to have a continuous sidewall.

SUMMARY OF THE INVENTION

In an aspect of the invention there is a railroad car. It has a car body mounted on railroad car trucks for rolling motion in a longitudinal direction along railroad tracks. The car body has upstanding first and second sidewalls running length-wise therealong. Each of the sidewalls has an uppermost margin. The car body has first and second ends. The car body has a lading receptacle defined between the first and second sidewalls and the first and second ends. At least the first end includes a lading discharge door assembly. The lading discharge door assembly includes a headframe member, and a door mounted below the headframe member, the door being movable between a closed position in which to discourage discharge of lading, and an open position in which to permit discharge of lading. The headframe member is connected to the upper margins of the first and second sidewalls at motion tolerant connections. The motion tolerant connections have a degree of freedom accommodating lateral angular deflection of the upper margins of the first and second sidewalls.

In a feature of that aspect of the invention, the motion tolerant connections are pin-joint connections. In another feature, the upper margins of the first and second sidewalls each include a top chord. The headframe member is connected to ends of the top chords. The respective motion tolerant connections permit rotation about a vertical axis of the top chord ends relative to the end frame member. In another feature, the headframe member defines top chord deflection nodal points, and defines a fixed spacing therebetween. In a further feature, the headframe member has a first end and a second end. The lading discharge door assembly includes first and second side frame members. The first and second side frame members are connected to, and extending downwardly of, the first and second ends of the headframe member respectively, whereby the headframe member and the first and second side frame members co-operably define a downwardly opening U-shaped frame. The headframe member and side frame members are secured to each other at moment connections whereby the U-shaped frame is resistant to lateral racking. In an additional feature, each moment connection includes a non-welded gusset. In another further feature, each moment connection includes an inside flange and an outside flange, the inside and outside flanges having flange continuity through the connection.

In still another further feature, the U-shaped frame is a prefabricated U-shaped frame, and is adjustable in the longitudinal direction of the railroad car on assembly. In an additional feature, the first and second sidewalls include sidewall sheets that overlap the first and second side frame members respectively. In another feature, the door is hingedly connected to the headframe member. In an additional feature, the assembly includes a door seal between the door and each of the first and second side frame members. In still another feature, the car includes a tarpaulin dome. In a still further feature, the first and second top chords are mounted along the uppermost margins of the first and second sidewalls. The car includes a tarpaulin dome. The tarpaulin dome has first and second mounting fittings by which the tarpaulin dome is secured to the first and second top chords at respective first and second tarpaulin dome connections. At least one of the first and second tarpaulin dome connections is tolerant of lateral motion between the tarpaulin dome and the associated one of the first and second top chords.

In another feature, the upper margins of the first and second sidewalls include a first top chord and a second top chord. The headframe member has a first end and a second end. The first and second ends of the headframe member are connected to respective ends of the first and second top chords. The respective motion tolerant connections are pin joint connections defining nodal points that permit rotation about a vertical axis of the top chord ends relative to the end frame member. The lading discharge door assembly includes first and second side frame members. The first and second side frame members are connected to, and extending downwardly of, the first and second ends of the headframe member respectively, whereby the headframe member and the first and second side frame members co-operably define a downwardly opening U-shaped frame. The headframe member and side frame members are secured to each other at moment connections resistant to lateral racking of the U-shaped frame. The moment connections include one of (a) a non-welded gusset; and (b) a pair of inside and outside flanges between the headframe member and each side frame member, each inside flange being continuous between the headframe member and one of the side frame members. The first and second sidewalls include sidewall sheets that overlap the first and second side frame members respectively. The U-shaped frame is a prefabricated U-shaped frame, and is adjustable in the longitudinal direction of the railroad car on assembly. The door is hingedly connected to the headframe member. A door seal acts between the door and each of the first and second side frame members. In a still further feature, the car includes a tarpaulin dome. The tarpaulin dome has first and second mounting fittings by which the tarpaulin dome is secured to the first and second top chords at respective first and second tarpaulin dome connections. At least one of the first and second tarpaulin dome connections is tolerant of lateral motion of between the tarpaulin dome and the associated one of the first and second top chords.

In another aspect of the invention, there is a prefabricated end door assembly for an open top railroad freight car. It has a headframe member; a first side frame member; and a second side frame member. The headframe member, first side frame and second side frame are assembled to form a downwardly opening U-shape, a doorway being defined inside the U-shape. The headframe member has a first end and a second end. The headframe member extends cross-wise between the first and second side frame members. The first frame member is connected to the first end of the headframe member at a first moment connection. The second frame member is connected to the second end of the headframe member at a first moment connection. There is a first pin joint connection by which to secure the end door assembly to a first top chord of a railroad car sidewall. There is a second pin joint connection by which to secure the end door assembly to a second top chord of a car sidewall.

In a feature of that aspect of the invention, a door is mounted within the U-shape, the door having a door seal. In another feature, an outwardly opening door assembly is pivotally mounted to the headframe member. In another feature a seal is mounted between the door and each of the first and second side frame members. In a further feature, the door has upper corners having one of (a) a chamfer; and (b) a radius. In still another feature each moment connection includes at least a first gusset having a non-welded connection to at least one of the headframe and the first side frame. In a yet further feature, each moment connection includes an inboard gusset and an outboard gusset, the inboard gusset and the outboard gusset being secured by mechanical fasteners to the first end of the headframe member and to an upper end of the first side frame member. In still another feature, the first moment connection includes an inner flange and an outer flange co-operably mounted to resist lateral racking of the assembly. In another feature, the first moment connection provides flange continuity between the first side frame member and the first end of the headframe member. In still another feature the first moment connection includes one of: (a) an out-of-plane boss having an accommodation for a pin of a pin joint; and (b) a pin accommodation defined in the first end of the headframe member.

In another aspect of the invention there is an open top railroad freight car having a tarpaulin dome, the tarpaulin dome having top chord connection fittings accommodating lateral top chord deflection.

In still another aspect, there is a tarpaulin dome for an open top railroad freight car. It has a first portion and a second portion. The first portion defines a rib over which to tighten a tarpaulin. The second portion defines an extension for placement intermediate the rib and a top chord of an end wall of the open top railroad freight car. First and second top chord mounting fittings are located on opposite sides of the tarpaulin dome. Each of the first and second top chord mounting fittings inhibits vertical and longitudinal movement of the tarpaulin dome. Each of the first and second top chord fittings permits lateral play.

In a feature of that aspect of the invention, the first top chord mounting fitting includes an anchor rigidly mounted to a first sidewall top chord of the railroad car and a cross-wise oriented pin permitting the lateral play. In an additional feature, the pin is laterally slideable relative to the anchor. In another feature, the first portion has a mooring member for placement in opposition to the anchor, and the pin permits lateral play between the mooring member and the anchor. In an additional feature, each of the mooring member and the anchor has lateral play relative to the pin.

In another feature, the first top chord mounting includes an anchor for connection to a top chord of a sidewall of a railroad freight car. The anchor has a flange for rigid attachment to an upper flange of the top chord. The anchor has an upstanding web. The web faces the bow. The bow has a profile over which to tighten a tarpaulin. The bow has a flange formed at the first end thereof, the flange of the bow being located shy of the profile. The flange of the bow and the upstanding web of the anchor face each other in mutual opposition. The flange of the bow and the upstanding web of the anchor have mutually aligned apertures formed therein. The top chord mounting includes a plurality of pins seated in associated ones of the mutually aligned apertures.

In still another feature, there is a tarpaulin dome and a first retainer. The second portion of the tarpaulin dome has a longitudinally outboard margin distant from the bow. The first retainer is mounted to a transversely extending top chord of an end wall assembly of an open top railroad freight car. The first retainer defines an accommodation above that top chord and below the first retainers in which to seat the outboard margin of the second portion of the tarpaulin dome, the margin thereby being captured above the top chord by the retainer. In another feature, the accommodation permits lateral play of the margin. In sill yet another feature, the accommodation permits longitudinal play of the margin. In still another feature, the second portion of the tarp dome includes downwardly extending webbing transversely bracketed between sidewall top chords of the freight car, and longitudinally inboard of the most proximate end wall headframe of the freight car. In yet another feature, when installed on a freight car, the tarpaulin dome is free of welded connections to the freight car.

These and other aspects and features of the invention may be understood with reference to the description which follows, and with the aid of the illustrations.

BRIEF DESCRIPTION OF THE FIGURES

The description is accompanied by a set of illustrative Figures in which.

DETAILED DESCRIPTION

Figure 1A:
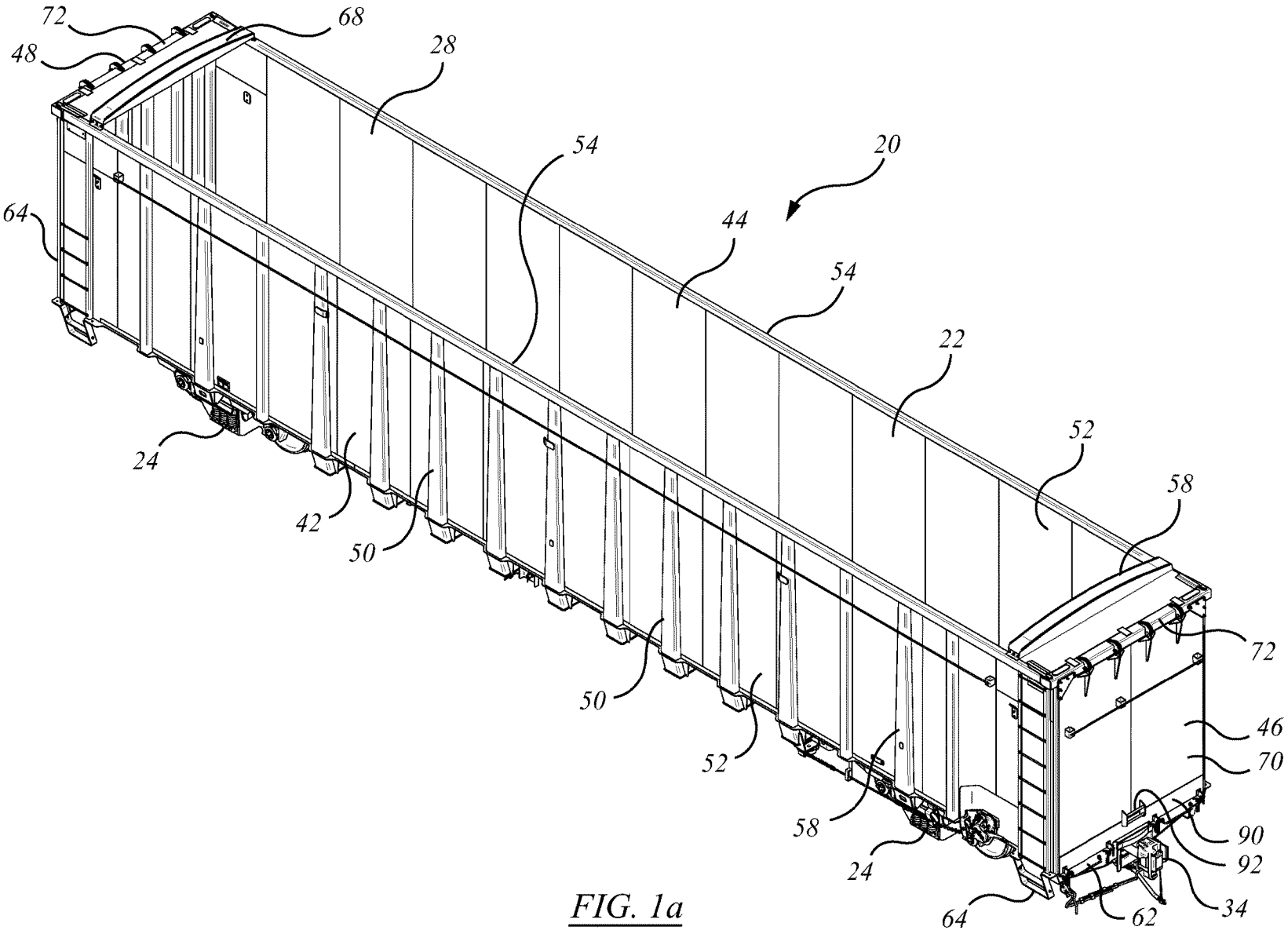
FIG. 1*a* is a general arrangement, isometric view of a railroad freight car.
Figure 1B:
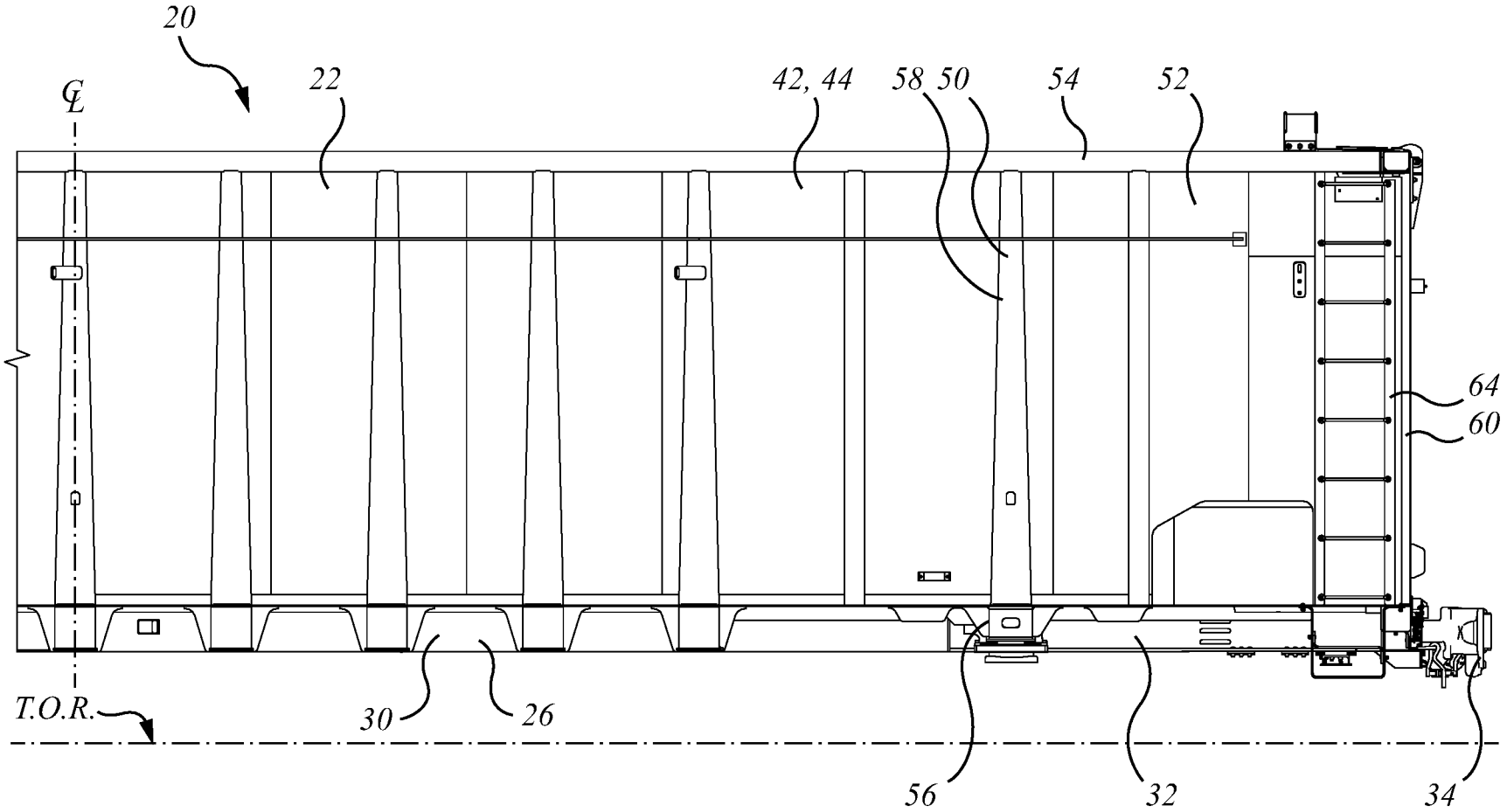
FIG. 1*b* is a side view of half of the railroad freight car of FIG. 1*a*, the car being generally symmetrical about its mid-span central transverse plane.
Figure 1C:
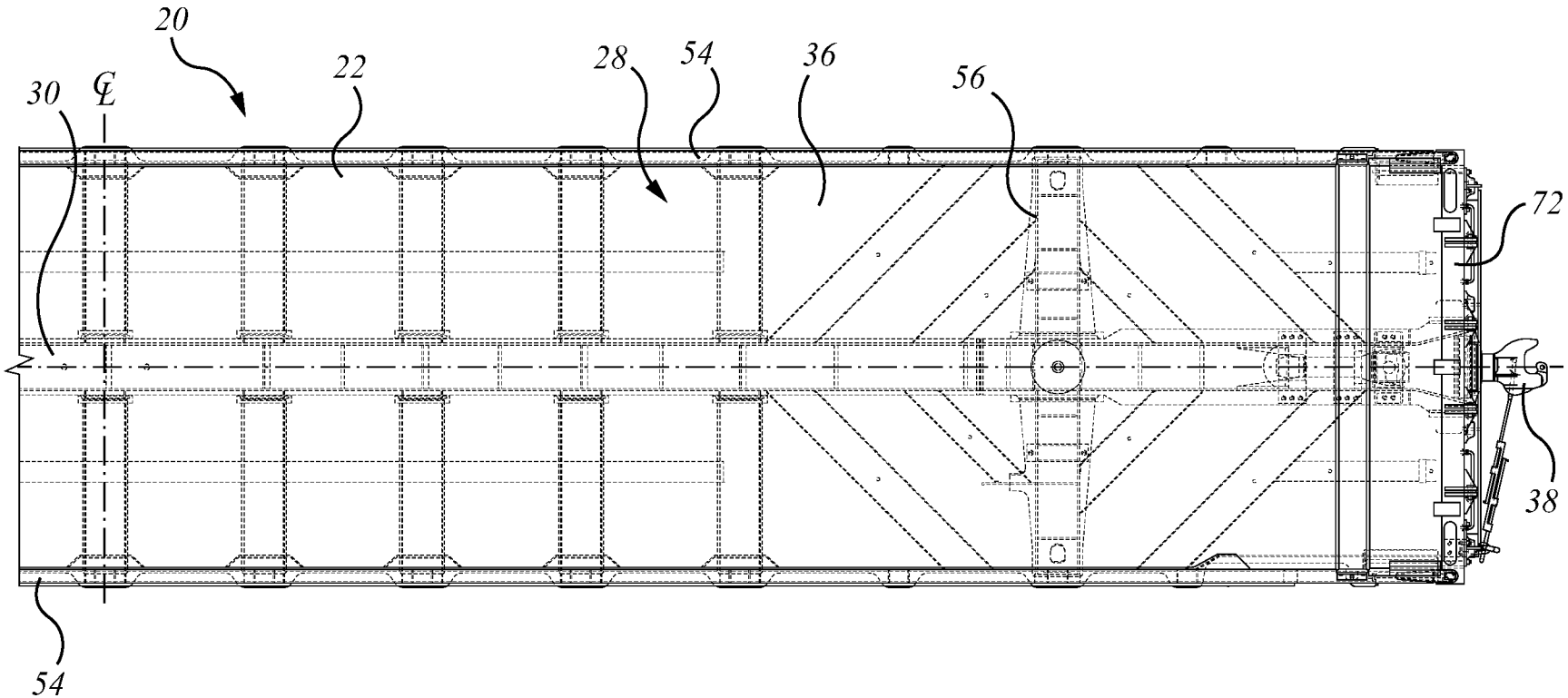
FIG. 1*c* is a top view of the railroad freight car of FIG. 1*b*, with half of the floor removed to show the underframe.
Figure 1D:
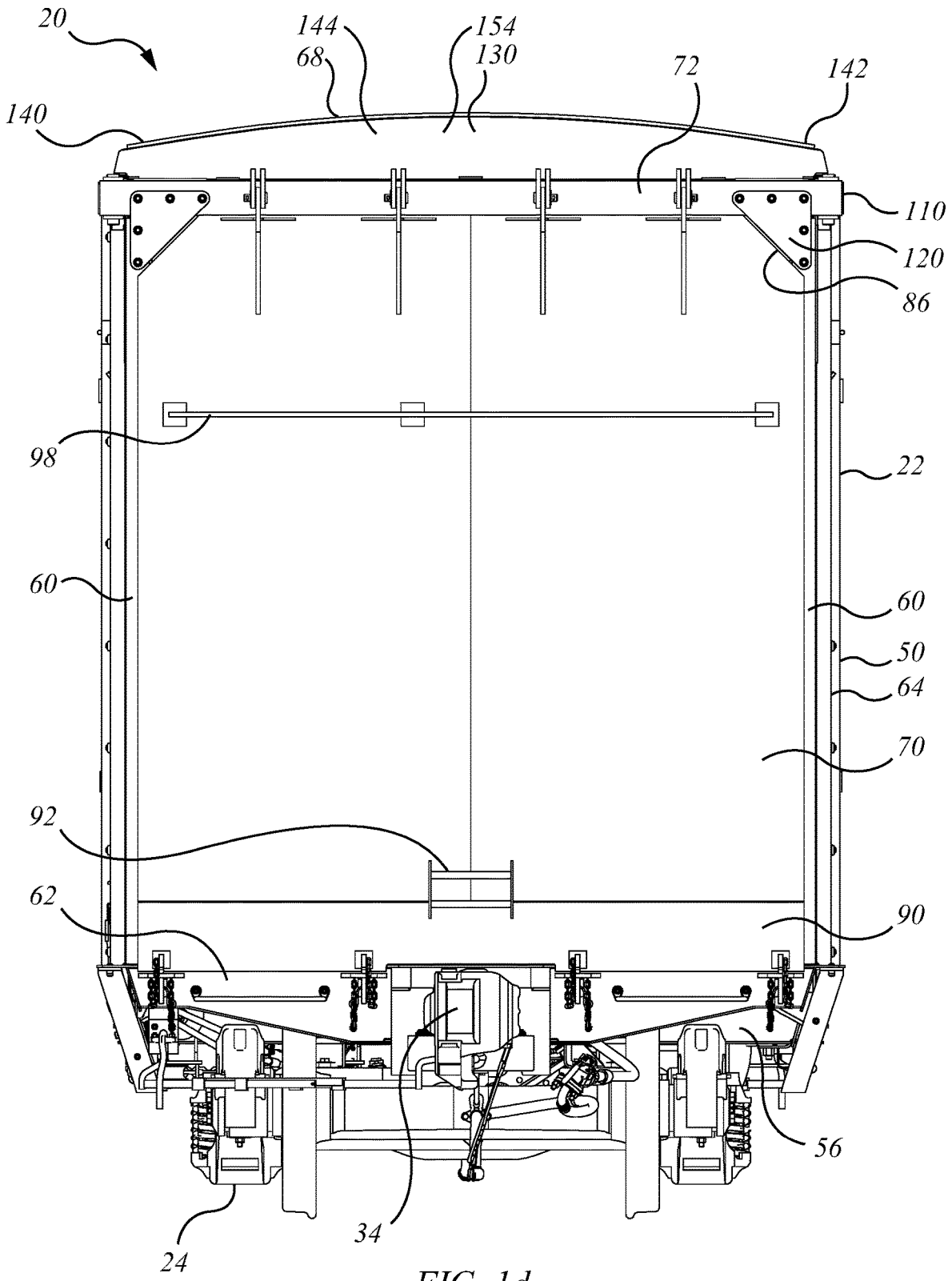
FIG. 1*d* is an end view of the car of FIG. 1*a;*
Figure 1E:
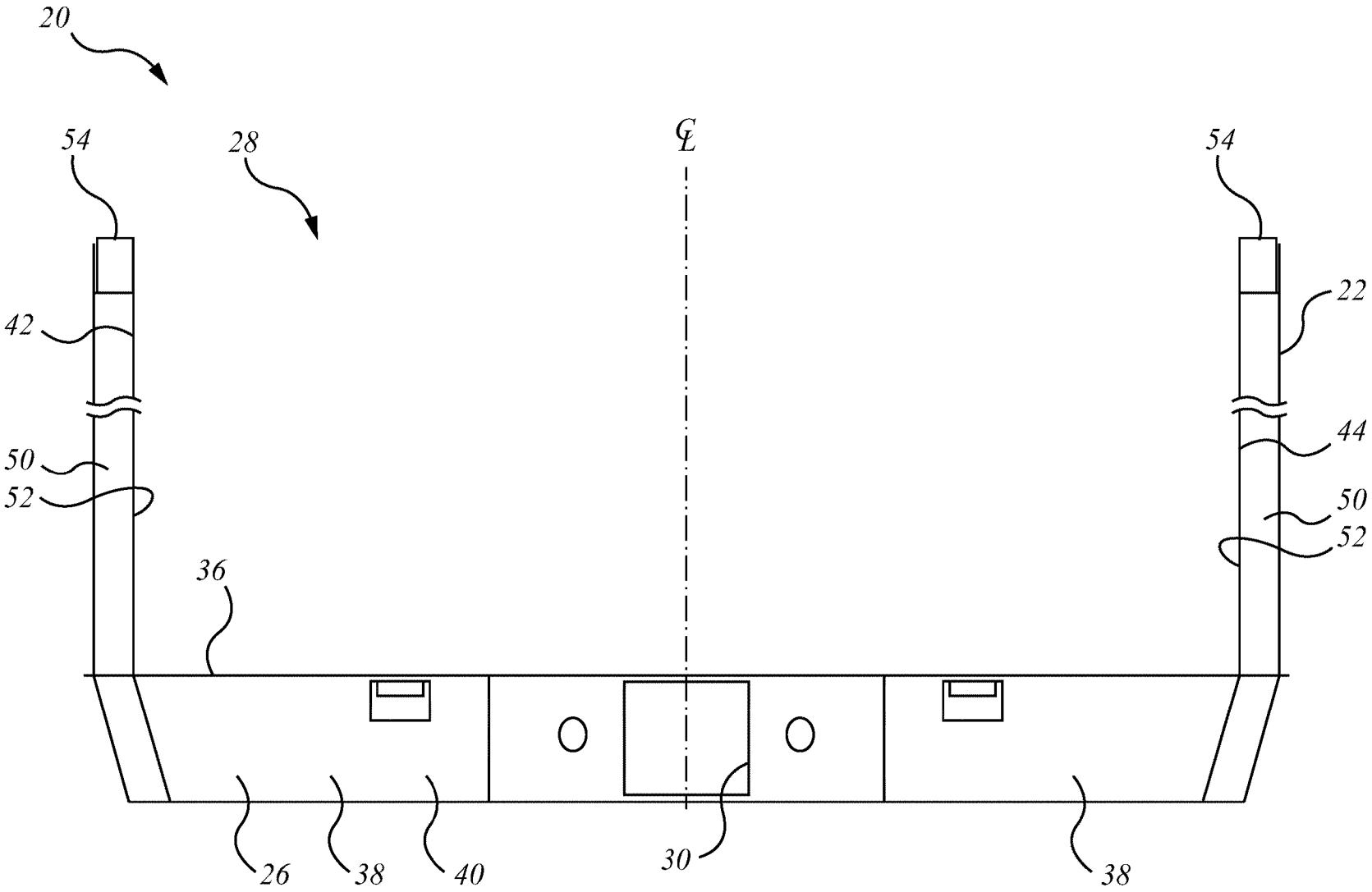
FIG. 1*e* is a vertically foreshortened end view of the car of FIG. 1*d* with the door removed.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

In terms of general orientation and directional nomenclature, for railroad cars described herein the longitudinal or lengthwise direction is defined as being coincident with the rolling direction of the railroad car, or railroad car unit, when located on tangent (that is, straight) track. In the case of a railroad car having a center sill, be it a stub sill or a straight-through center sill, the longitudinal direction is parallel to the center sill, and parallel to the top chords and side sills, as may be. Unless otherwise noted, vertical, or upward and downward, are terms that use top of rail, TOR, as a datum. In the context of the car as a whole, the terms cross-wise, lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. The directions correspond generally to a Cartesian frame of reference in which the x-direction is longitudinal, the y-direction is lateral, and the z-direction is vertical. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. In this document, reference is made to moment connections and pin-joint connections. A moment connection, or a built in connection, is a connection that will pass or carry or transfer or react a bending moment or moment-couple. A pin-joint connection, by contrast, is a connection that will transfer loads in tension or compression or shear, but that has little or no ability to transmit a bending moment. While a pin joint connection is most commonly a hinge, a hinge-like function that may be treated as a pin joint for the purposes of structural analysis may sometimes be achieve by other means, such as by a spring that is more compliant than adjoining structure. Reference may be made herein to web continuity or flange continuity. In such cases, parts or components are aligned, or mounted, on either side of a junction such that forces flow across the junction from one member into the other without interruption in the transmission of forces.

In this discussion it may by understood that persons of ordinary skill in the art are familiar with the Rules and Standards of the Association of American Railroads (the AAR), which govern interchange service in North America. This specification or the accompanying illustrations may refer to standards of the Association of American Railroads (AAR), such as to AAR plate sizes. To the extent necessary or appropriate, those references are to be interpreted in a manner consistent with the Rules and Standards as extant on the earliest of the date of filing of this application or the date of priority of the earliest application from which this application claims priority, as if they formed part of this specification on that date.

Also for the purposes of the present discussion, it may be taken as a default that the structure of the car is of all-welded mild steel fabrication except as otherwise shown in the illustrations or indicated in the text. This need not necessarily be the case. Other materials, such as aluminum or stainless steel might be used. The structure may also be taken as being of steel fabrication, although, again, aluminum or stainless steel might be used, and the side web panels of the car, which may be made of mild steel, stainless steel, or aluminum might also be made from plastic composite material, which may be reinforced composite. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

In FIG. 1*a*-1*g*, there is a railroad car 20. Car 20 is typically an open top freight car. For the purposes of this description it may be taken that, aside from brake system and safety appliance features, the major structural elements of car 20 generally have both longitudinal and lateral symmetry. Freight car 20 has a car body 22 carried on a pair of longitudinally spaced apart railroad car trucks 24. Car body 22 has an underframe, indicated generally as 26, and a lading containment receptacle, indicated generally as 28, mounted to the underframe. Underframe 26 has a center sill 30, which, as shown is a straight-through center sill running from end to end of the car. Center sill 30 may typically have a draft sill 32 at each end, to which a coupler 34 is mounted. Underframe 26 may also include a set of cross-members 40, which may be cross-bearers 38 extending laterally to either side of center sill 30, to which they have a moment connection. A floor, or floor sheet, 36 may be mounted over the cross-bearer webs, and may form the top flange of the cross-bearers, such that the cross-bearers and floor form a unitary structure.

The car may also include left and right hand sidewalls 42, 44 and first and second end walls 46, 48. Sidewalls 42, 44 and end walls 46, 48 may typically stand upwardly of, and extend upwardly away from underframe 26 and floor sheet, or sheets, 36. Sidewalls 42, 44 may include vertical supports in the nature of an array of sidewall posts 50. A number of posts 50 may be located at the longitudinal stations of, and may be structurally connected to, respective laterally outboard ends of corresponding ones of cross-bearers 38. In the embodiment shown, each post 50 is so mounted. In other embodiments a majority of posts 50 may be aligned with corresponding cross-bearers; or where both cross-bearers and cross-ties are employed, every other alternating post 50. The sidewall posts 50 may be mounted to sidewall sheets 52 which run from the floor sheet 36 to a top chord 54 that runs the length of the car. The sidewalls terminate at end posts 60 mounted at the points (i.e., corners) of the car and that are lapped on the outboard face by the side sheets 52. At each end of the car there is an end bolster 62. At each corner of the car there is a ladder 64 mounted longitudinally inboard of the respective end post 60, the ladder being mounted on the outboard face of the sidewall sheet.

The connection between cross-bearer 38 and side posts 50, at such locations as may be, may have the form of a structural knee capable of transmitting a bending moment between the respective side post and associated cross-bearer. In such a knee the bottom flange of the cross-bearer and the floor sheet defining the top flange of the cross-bearer extend along opposite sides of a web member, or web members, and the outside flange of the side post and the inside flange of the side post defined by the sidewall sheet or by an underfloor extension thereof having web continuity therewith run along two other sides of the end of the cross-bearer web, such that the moment couple of the cross-bearer and the moment couple of the side post share the end shear webs. Similar structural knees are found at the ends of main bolster 56 and the associated main side post 58. When the side posts on either side of the car and a cross-bearer are mated in this way they form a generally U-shaped frame which is, in effect, a spring. The upper ends of the spring are connected to the top chords 54. The spring so formed may tend to resist lateral deflection of the top chords 54 and sidewalls 42, 44 more generally.

Thus there is a general car body structure 22 in which the floor 36, upstanding sidewalls 42, 44, and end walls 46, 48 co-operate to define lading containment receptacle 28. Receptacle 28 is, or is predominantly, open topped, so that it may be loaded by introducing lading material from above. In transit, it may be desirable to encourage the lading to stay within the car. To that end, a tarpaulin or cover may be used. To aid in the installation of a tarpaulin, the car may be provided at either end with a tarpaulin dome 68, such as may be described in greater detail below.

Figure 1F:
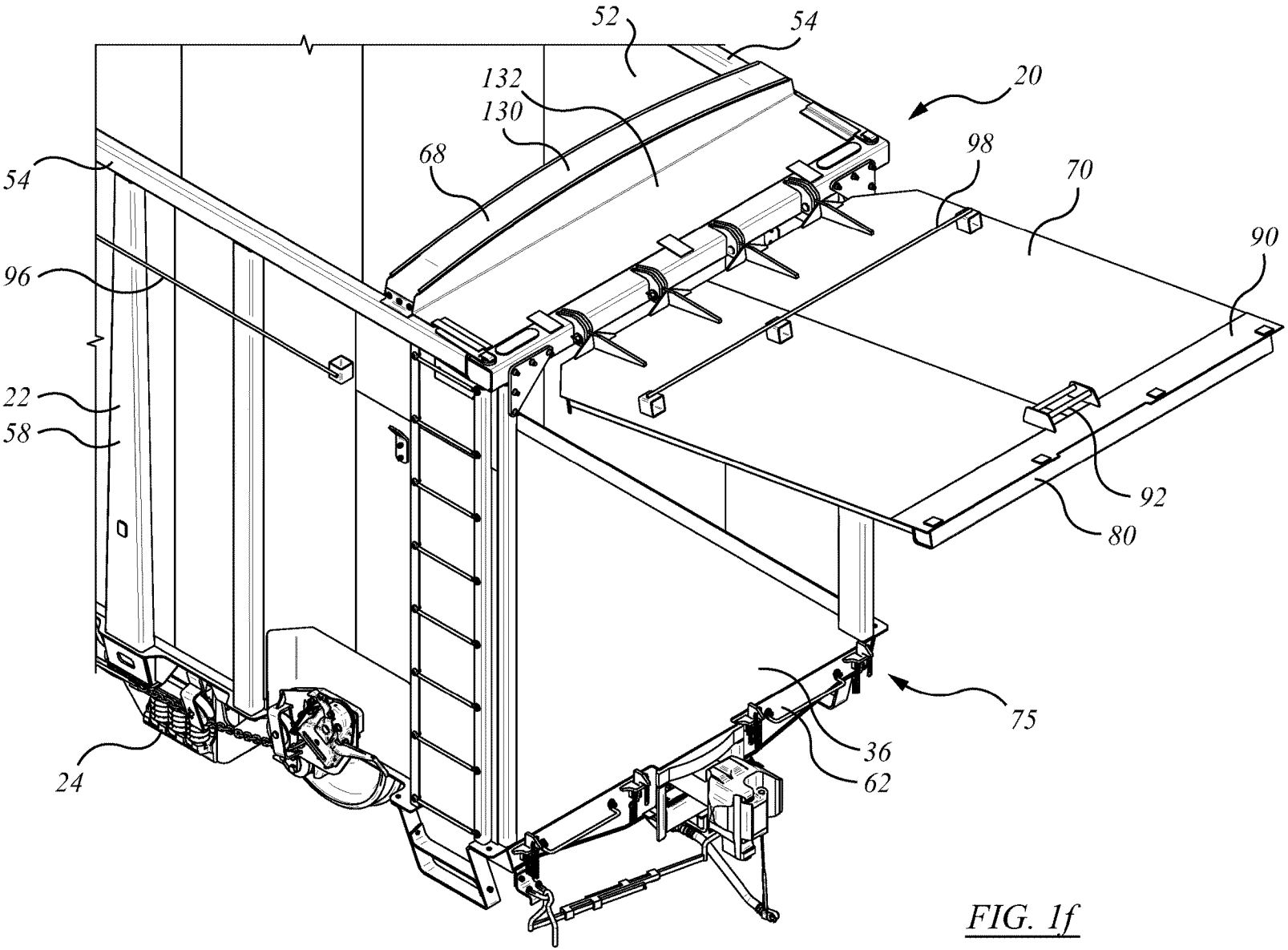
FIG. 1*f* is a perspective view of a the car of FIG. 1*a* with an end door in an open condition, illustrating the operation of end doors for unloading such cars.
Figure 1G:
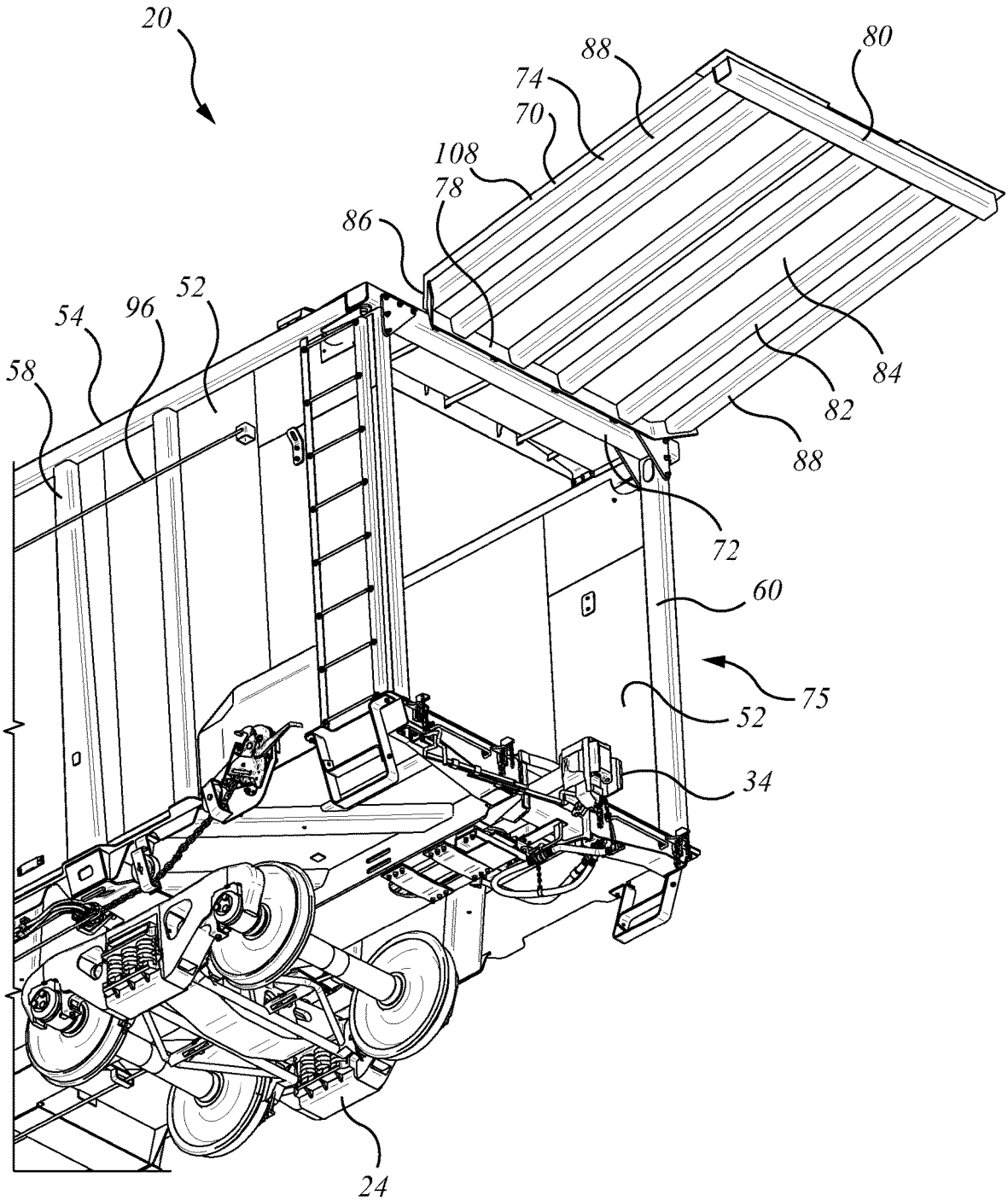
FIG. 1*g* is another perspective view showing the open end door of FIG. 1*f;*
Figure 2A:
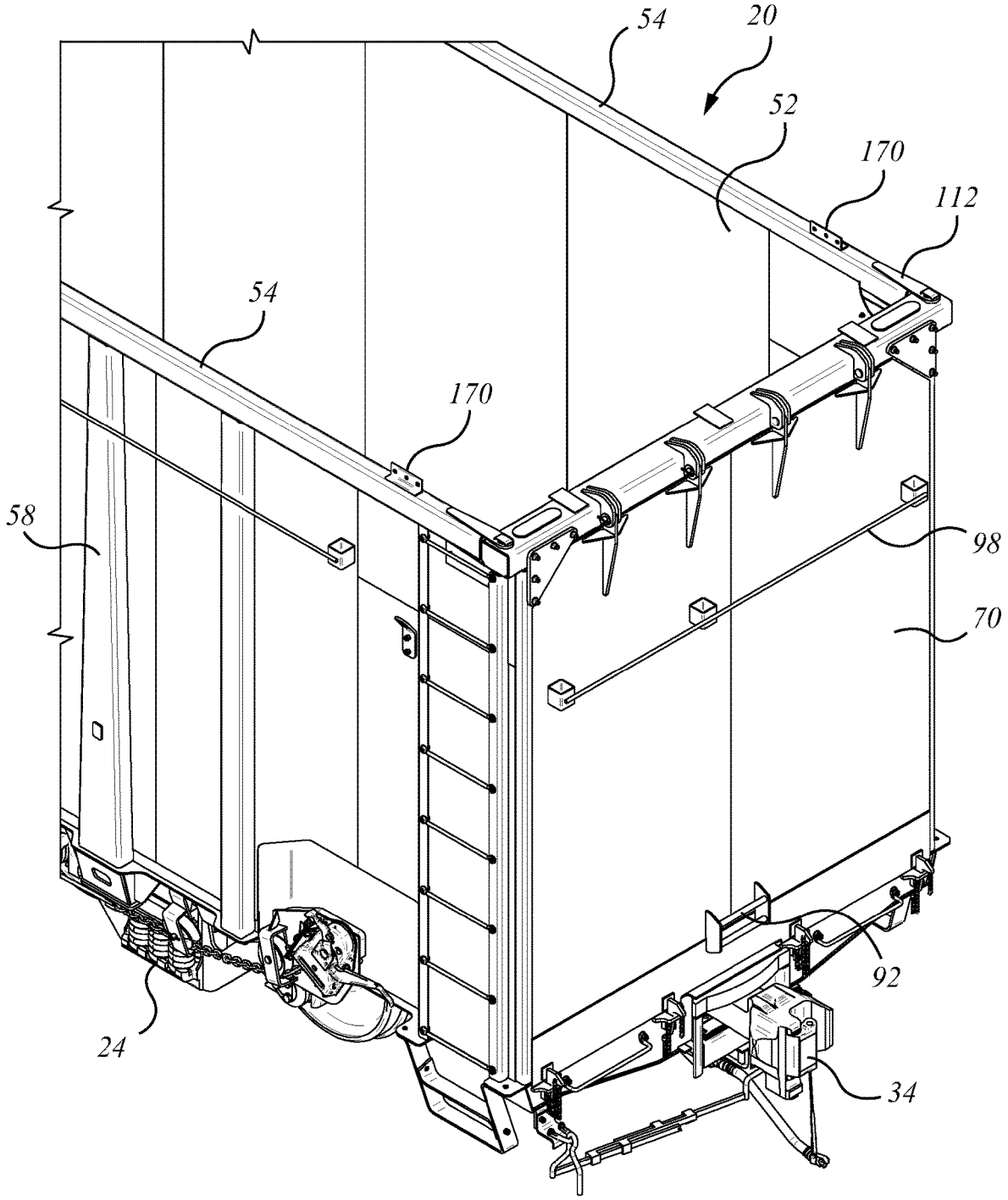
FIG. 2*a* shows an enlarged perspective view of and end of the car of FIG. 1*a;*
Figure 2B:
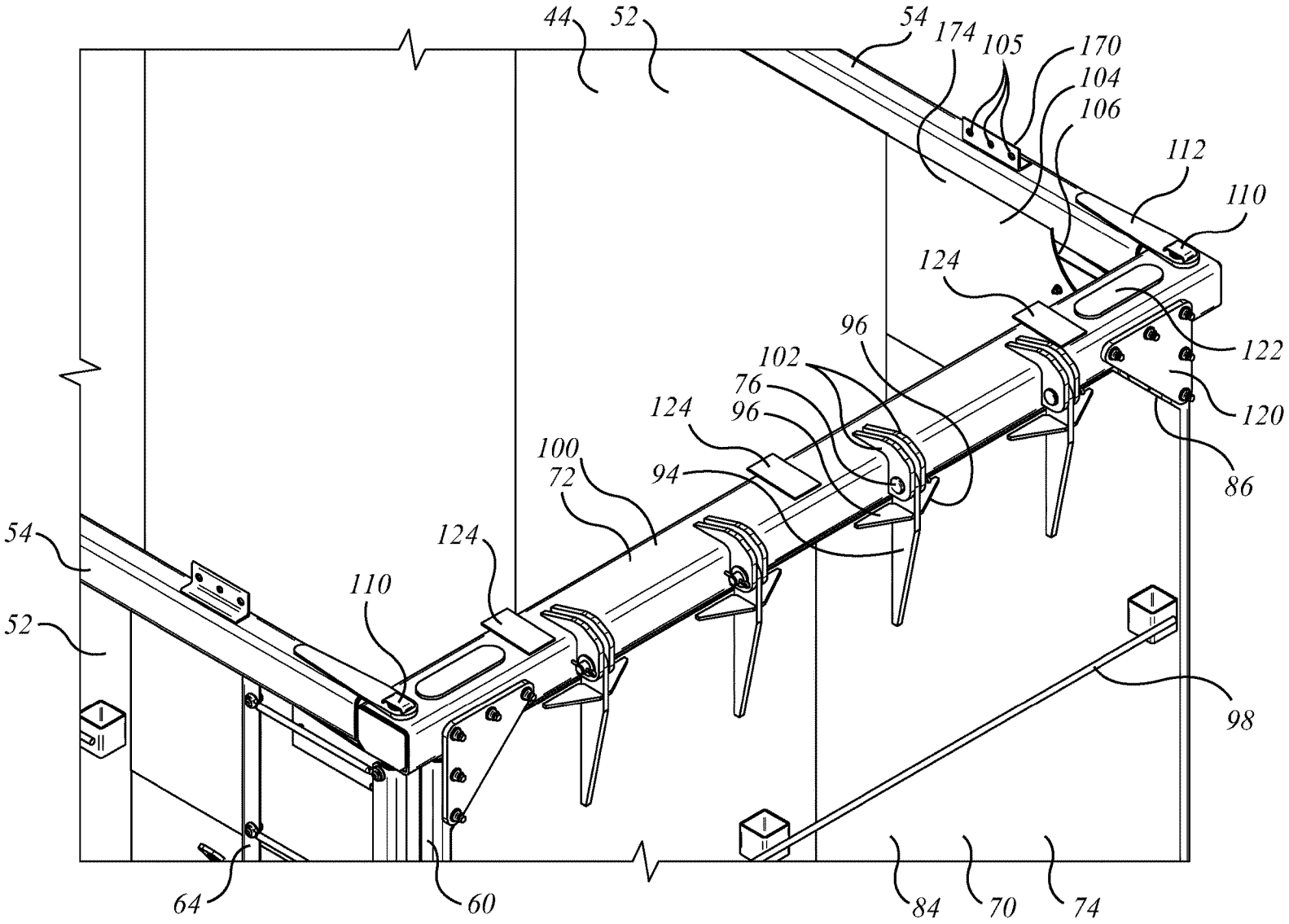
FIG. 2*b* shows a further enlarged detail of the car of FIG. 2*a;*
Figure 2C:
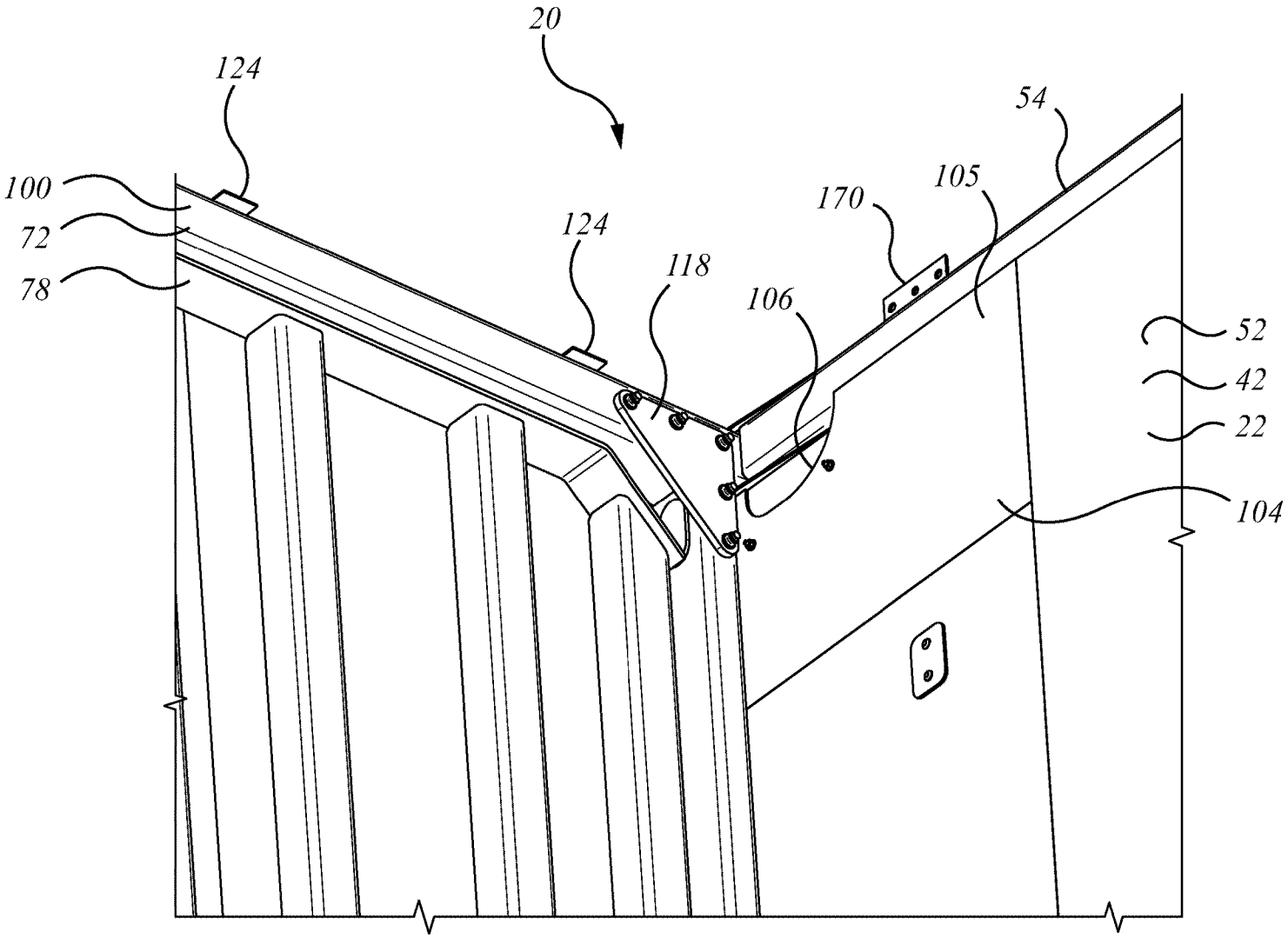
FIG. 2*c* shows a perspective view from inside the car of FIG. 2*b;*

Car 20 may be intended for a type of low density lading such as woodchips or cottonseeds, and so on. Such lading may tend not easily to flow through a hopper discharge or other more conventional outlet. Accordingly, the end walls 46, 48 of car 20 are each provided with a lading discharge in the form of an end door, or end door assembly, 70, that is movable between a closed position as shown in FIG. 1*a*, and an open position as shown in FIGS. 1*f* and 1*g*. When door 70 is fully open, a front end loader can be used to unload the car. As depicted in FIGS. 1*f* and 1*g*, door 70 is hinged at its top edge, such that it is opened by lifting the bottom margin of the door upwardly and longitudinally outwardly, as with a crane or other suitable lifting apparatus.

In the embodiment of FIGS. 1*a*-1*g*, end door assembly 70 is a door-and-frame assembly that includes a pre-fabricated door frame and a mating pre-fabricated door. The frame of end door 70 includes a lateral top chord, or lateral cross-member, or header, or headframe or headframe member 72, however it may be termed; and also first and second side frame members, shown as the left and right end posts 60, combined to form a downwardly open U-shaped frame or arch. A doorway, notionally indicated as 75, is defined in the opening inside the U-shape. The top ends of the side frame members are joined to the respective first and second ends of headframe member 72 at moment connections. That is, the connection between the headframe member and each respective side frame member is intended to be capable of transmitting a bending moment. Accordingly, in contrast to a pin-joint connection, moment connections tend to be able to resist lateral deflection of the structure into a trapezoidal shape, sometimes referred to as "racking". Lateral parallelogram deflection of a door-and-doorframe assembly may tend to be problematic in respect of door fit-up and door sealing.

As noted above, the end door assembly 70 also includes the mating door or door assembly, indicated generally as 74. On installation, the frame is installed, and then door assembly 74 is attached to swing from header 72 by a set of hinge assemblies 76. In the embodiment shown in FIG. 1*a*, there are four such hinge assemblies 76 spaced across the top edge of door assembly 74.

Door assembly 74 has a head flange 78; a base frame or sill 80; a set of upstanding stiffeners 82 joined to and running between head flange 78 and base, or distal, sill 80; and a main door sheet 84. The upper, or proximal, margin of sheet 84 may be chamfered at the corners, as indicated at 86. Base sill 80 may be a channel or hollow structural section that is welded to the inside face of the bottom margin of sheet 84. Upper flange 78 may be made of flat bar welded inside the top margin of sheet 84, the flat bar being formed (i.e., bent) to follow the shape of the margin, including the chamfers at the upper corners. Longitudinal stiffeners 82 may be closed or open structural sections. In the embodiment shown they are generally trapezoidal or V-shaped channel welded toe-in to the inside face of door sheet 84. Two of those members, identified as 88, form the structural edges of the door.

On the outside of the door there is an external lower or distal edge doubler 90 such as may tend to protect or reinforce the bottom edge of the door, and a lifting interface member, such as a cleat or hook or grip 92, however it may be termed, which, in the example shown may include two laterally spaced webs welded to the door, with a pair of transverse rods extending between the webs to provide an anchor point for a hook or chain, as may be.

At the upper or proximal margin, the movable portions of hinge assemblies 76 may include a radially oriented web 94 with a pivot point for a hinge pin; and laterally extending gussets 96 such as may tend to stabilize the central web piece and provide a load spreading function. The outside of the door may also have a tarp cover securement fitting, or apparatus or interface, such as a reefing bar mounted on stand-offs, as shown at 98.

Header 72 may include a main lateral beam member 100, such as may be a square or rectangular section of a seamless steel tube. Spaced along beam member 100 are pairs of profile cut webs 102 of hinge assemblies 76 that are welded to beam member 100 such that each pair of webs 102 defines a clevis in which to receive an associated hinge web 94.

It may be noted that in the embodiment shown, the top longitudinally outboard corner portion 104 of the sidewall web sheet 52 has a cut-out 106 at the corner. The upper, inboard edge 105 of portion 104 overlaps, and is lap-welded to, top chord 54 of sidewall 42 or 44, as may be. The longitudinally outboard end, or margin, or edge, 115 overlaps, and is lap welded to, the outside face of end post 60. As may be noted, end post 60 and top chord 54 are not attached directly to each other.

At each of its ends, beam member 100 has a pin-jointed connection 110 to the corresponding adjacent end of top chord 54 of the associated sidewall. The pin jointed connection has upper and lower hinge members 112, 114 that have roots, or stems, or ends welded to the respective upper and lower flanges of top chord 54, thereby forming a pair of eyelets, or a clevis, of the pin-joint connection. A pin bushing 117 is welded inside the end of beam member 100 and, on assembly aligns with, and co-operates with mating accommodations in hinge members 112, 114, such that pin 116 passes through all three to complete the hinge. The pin-joint so formed is a non-welded connection. It functions as a deflection nodal point for the end of top chord 54. That is, since beam member 100 is of fixed length it establishes fixed spacing between the pin joints. The end frame of door assembly 70 is laterally stiff. Accordingly, the pin joints inhibit longitudinal and transverse motion, and tend to define a datum point, or node, of fixed or substantially fixed location. The nodes thereby defined are motion tolerant connections that each permit a degree of freedom relative to that fixed-position datum or nodal point—namely angular deflection about the vertical axis of the pin—that may accommodate reversing deflection of the associated top chord rather than imposing reversing stresses on a rigid, fixed-connection weldment.

In this structure it may be noted that posts 50 (and 58) stand outside, and are welded to the outside of, the web defined by side sheet 52. By contrast, end post 60 stands inside, and is lapped by, the outboard edge of sheet 52. Thus end post 60 is offset inboard relative to posts 50 (and 58). Top chords 54 are mounted on top of posts 50, and sheet 52 is lap welded to the inside face, or inside web, of top chord 54. Accordingly, top chord 54 is offset outboard relative to end posts 60. Consequently, in this embodiment end posts 60 meet cross-member 100 at a T-junction. The ends of cross-member 100 extending outboard past end posts 60, such that connection 110 is longitudinally in line with top chord 54.

Given the low density of the intended lading the car sidewalls may be of maximum height and the car may be quite long. Nonetheless, car 20 may tend to cube out rather than weigh out, i.e., even for the largest AAR plate size and car length, the volumetric capacity of the car may be insufficient to contain a volume of lading corresponding to the permissible maximum gross weight on rail. Since the end wall is to open as a door, the ability of the end wall to act as a stabilizing transverse shear web to stiffen the sidewall structure may not be as great as if the end wall were a solid structure. In that context, the lateral stiffness of the sidewalls may depend upon the U-shaped frames and their ability to function as springs to resist parallelogram deflection, or "racking". The stiffness of the top chords in longitudinal buckling may tend to be relatively soft, and the top chords of the sidewalls may tend to be prone to lateral deflection.

There may be quite low lateral stiffness in the top chord of the sidewalls, and significant lateral deflection. In the past the reversing of stresses in weldments has been known to cause cracking. That is, the scope for lateral deflection may be such that, if the connection were a welded connection, the deflection of top chord 54 might otherwise tend to cause reversing stress in the weldment, thereby tending to cause crack formation at the junctions of the top chords of the sidewall with the top chords of the end walls of the car. In the embodiment described, the pin jointed connection between the top chord and the upper beam member 100 of door assembly 74 may tend to function as a deflection nodal point for the top chord, or hinge, or intentionally compliant member, permitting a degree of freedom of motion, namely rotational deflection about a vertical axis (i.e., of the pin), thereby tending to accommodate deflection of the top chord by giving it that rotational degree of freedom.

The forces tending to cause shear deflection, such as lateral parallelogramming deflection, also tend to impose reversing forces on the moment connections of the head-frame member 72 and the side frame members, namely end posts 60. Mindful of this racking issue, the moment connection between beam member 100 and end post 60 may be a non-welded connection. In an embodiment of that moment connection, beam member 100 has an inside gusset plate 118 and an outside gusset plate 120. In this instance, gusset plates 118, 120 are triangular in plan form, and have a size corresponding to the chamfer of the profile of the top of the door. The mechanical fastening to the side posts may be a non-welded connection, such as a mechanical connection typically in the form of bolts or rivets. One such type of fastener is known as a Huck (t.m.) bolt, which deforms plastically on assembly. An access opening is provided in the top surface of beam member 100 to permit the mechanical attachment fasteners for gussets plates 118, 120 to be installed. The opening is closed up afterward by a welded cover plate 122.

On assembly, door 70 is mounted in the U-shaped frame, and door seal members and 108 on the sides of the door are adjusted to fit. On installation, the U-shape door frame is positioned in place, the pins are positioned in the pin joints, and then the side sheets are lap welded to end posts 60. This may tend to facilitate assembly in a manner more likely to yield the appropriate seal relationship between the door and the frame.

In summary, in each embodiment shown and described the car has a door and door frame mounted at the end of a gondola car. This type of car is typically used to transport woodchips or cottonseed. The door hangs on a frame. The frame has a header and two side posts. The door is hinge connected to the door header. The header runs across the top of the door opening and is connected to the top chords at either side of the car. The door posts, at either side of the door opening, are positioned inside the side sheets and tie into the header at each upper corner. The side sheets lap onto the door posts to allow longitudinal adjustment of the side assemblies and the door frame relative to each other, at assembly. The side posts are connected to the header with a tie plate that is bolted to both members.

Figure 3A:
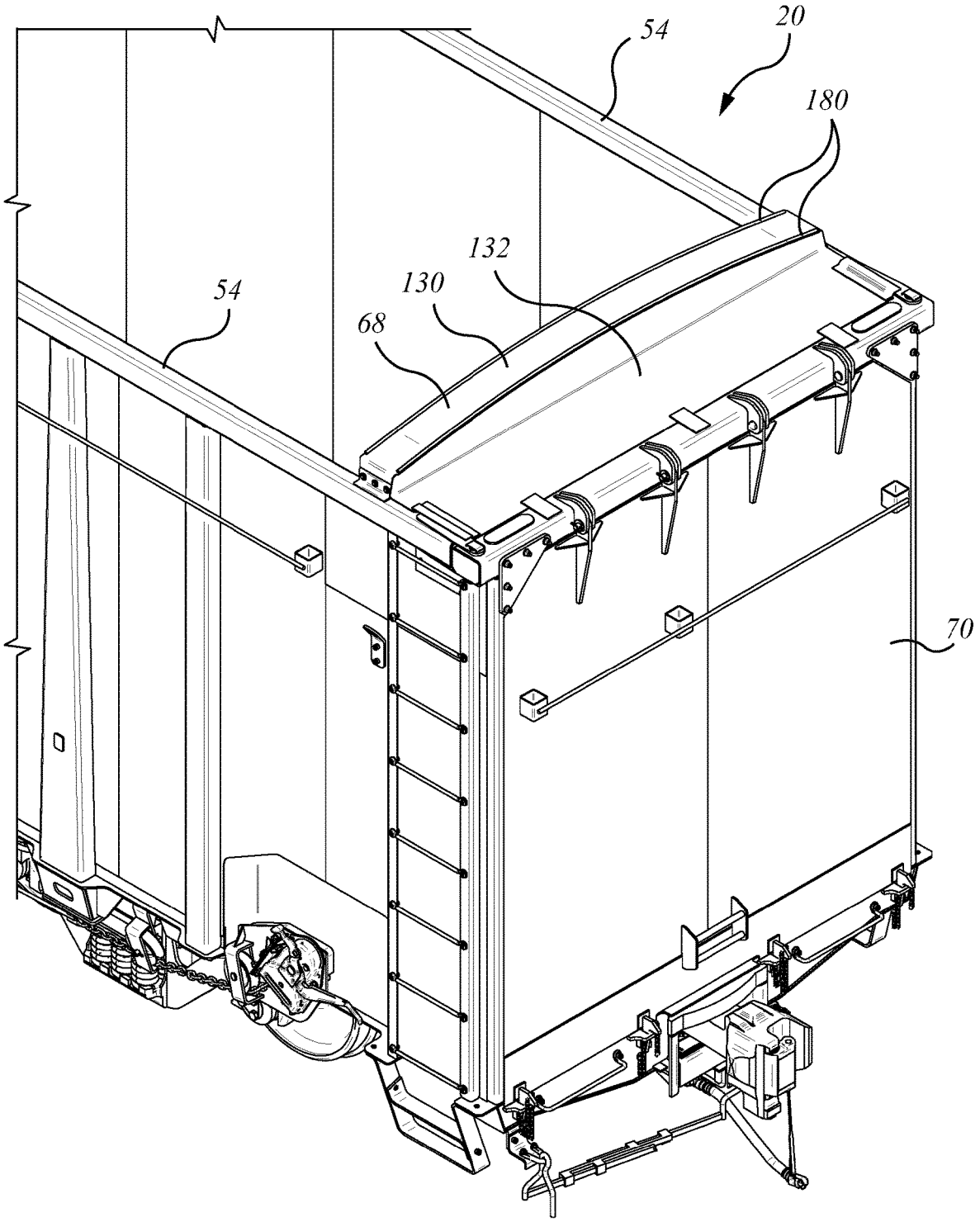
FIG. 3*a* shows the freight car of FIG. 2*a* with a tarpaulin dome installed.
Figure 3B:
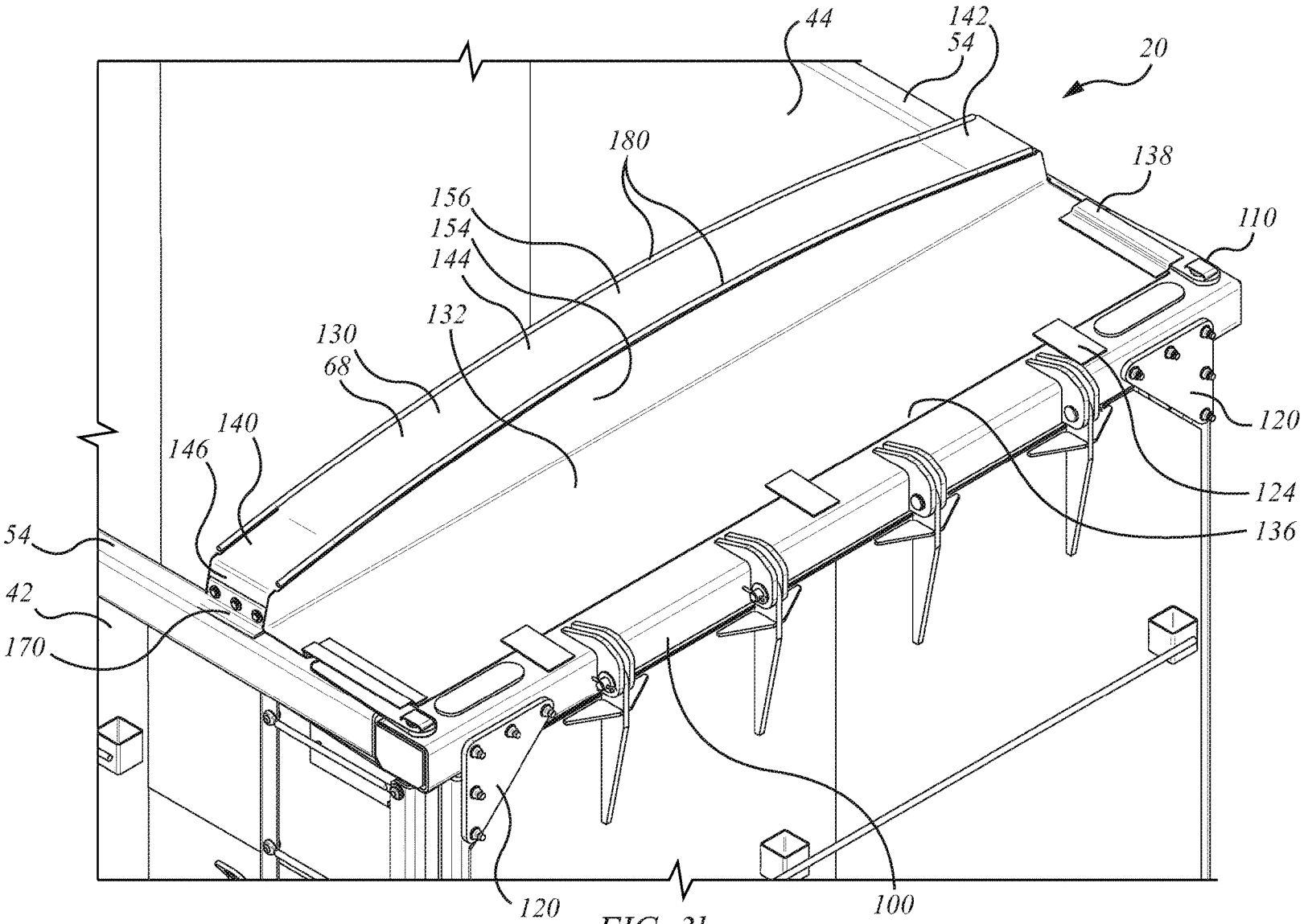
FIG. 3*b* shows the freight car of FIG. 2*b* with a tarpaulin dome installed.

As noted, car 20 may also have a tarp dome, 68, at each end. As may also be noted, beam member 100 also has a set of tangs, or tabs, or cleats, or abutments, or fingers 124 such as may be considered to be tarp dome retainers or tarp dome engagement members. Tarp dome 68 is shown in enlarged views in FIGS. 3*a*-3*b*. It has two predominant parts or portions. The first portion is a laterally extending member, or frame, or bow, or forming member, or simply a former 130, whatever terminology may be chosen. The second portion is a blank, or filler, or sheet, or cowling, or skirt, identified as a panel or spacer 132. Panel 132 extends longitudinally outboard from former 130. As installed, former 130 lies longitudinally inboard of end wall top chord, namely beam member 100. Panel 132 fills or covers the space lengthwise between beam member 100 and former 130, and width-wise between top chords 54 of sidewalls 42 and 44. The distal, or outboard edge 136 of panel 132 seats beneath the exposed inboard end of fingers 124, and the upper surface of beam member 100. Panel 132 also has corner tabs 138 that extend laterally outboard to overlie the tops of the hinges.

Figure 5A:
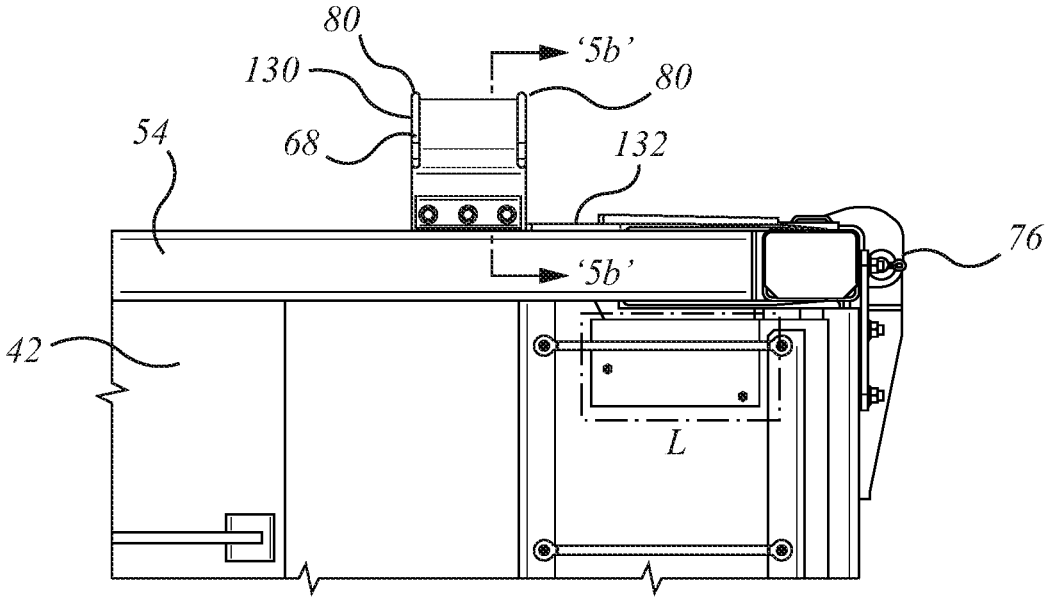
FIG. 5*a* shows an enlarged side-view detail of another corner of the railroad freight car of FIG. 1*b;*
Figure 5B:
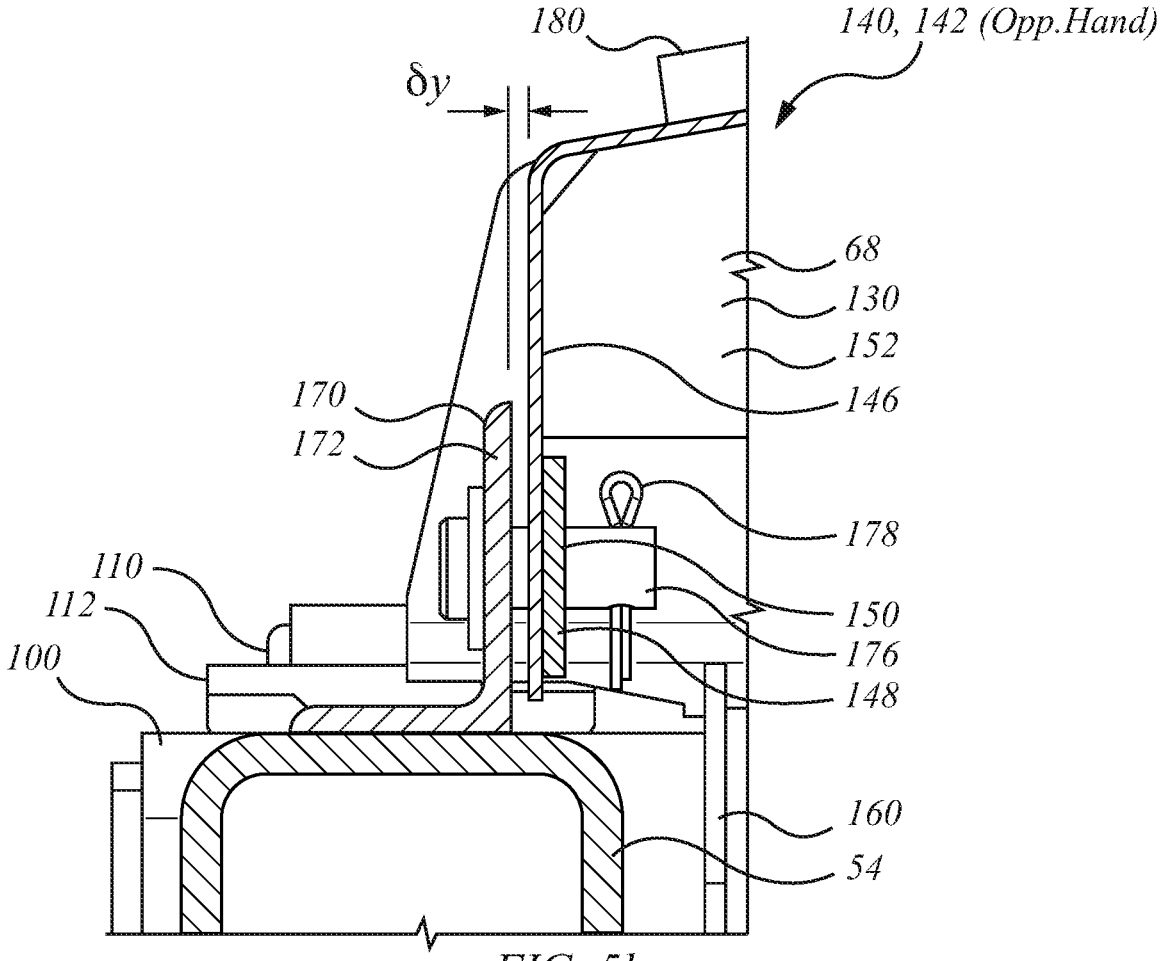
FIG. 5*b* shows a transverse cross-section of the detail of FIG. 5*a* taken on section '5*b*-5*b*' looking forward.

Former 130 has a first end 140, a second end 142 and a central portion 144. Central portion 144 is formed on an arc such as may correspond to the rounded up top of the lading, within the maximum profile permitted by the applicable AAR Plate size (e.g., Plate C, Plate E, or Plate F, as may be). As seen in FIG. 5*b*, each end 140, 142, has a downturned flange or web or leg 146. On the inside face of the lower margin of downturned leg 146 there is a reinforcement, or doubler, 148. A set of apertures 150 extends commonly through both leg 146 and doubler 148.

Former 130 has a first, or inboard, web 152 that extends cross-wise from end to end, the upper edge of web 152 being formed on the curve of the desired arc. Former 130 also has a second, or outboard, web 154 that may be a bent up leg of, or joined to, the inboard edge of panel 132. Former 130 also has a third portion or member, such as may be a flange or back, 156. Back 156 and webs 152 and 154 co-operate to form a channel section. The depth of the channel section varies according to the arc of the bowing shape of former 130.

Figure 3C:
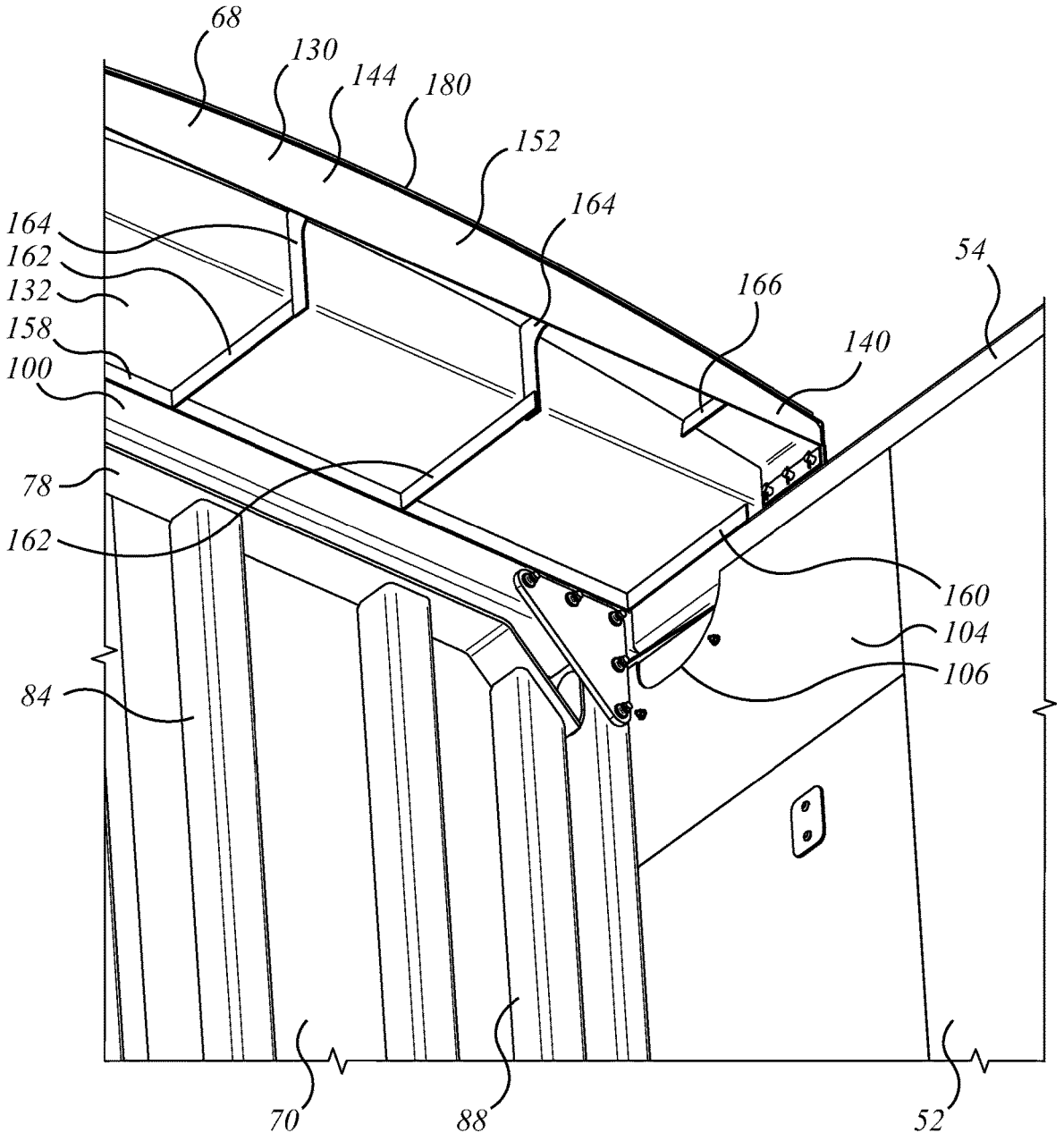
FIG. 3*c* shows a perspective view from inside the freight car of FIG. 3*b;*
Figure 4A:
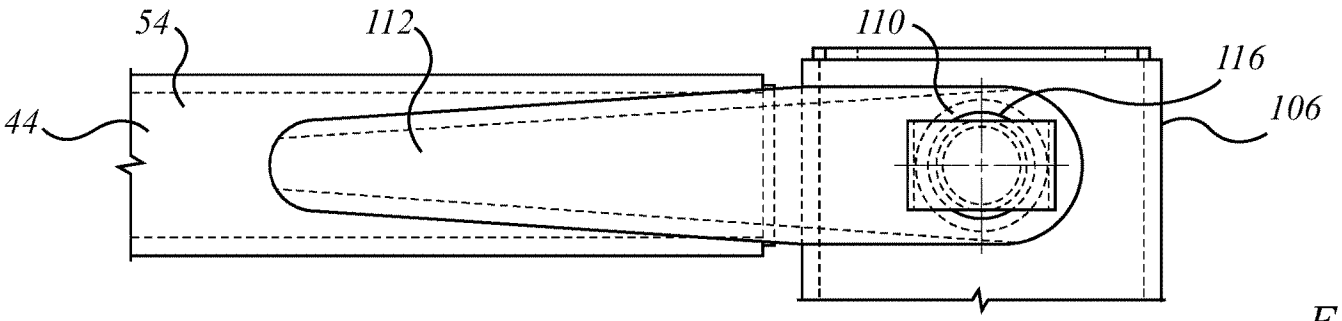
FIG. 4*a* shows a top view of a corner of the freight car of FIG. 2*a;*
Figure 4B:
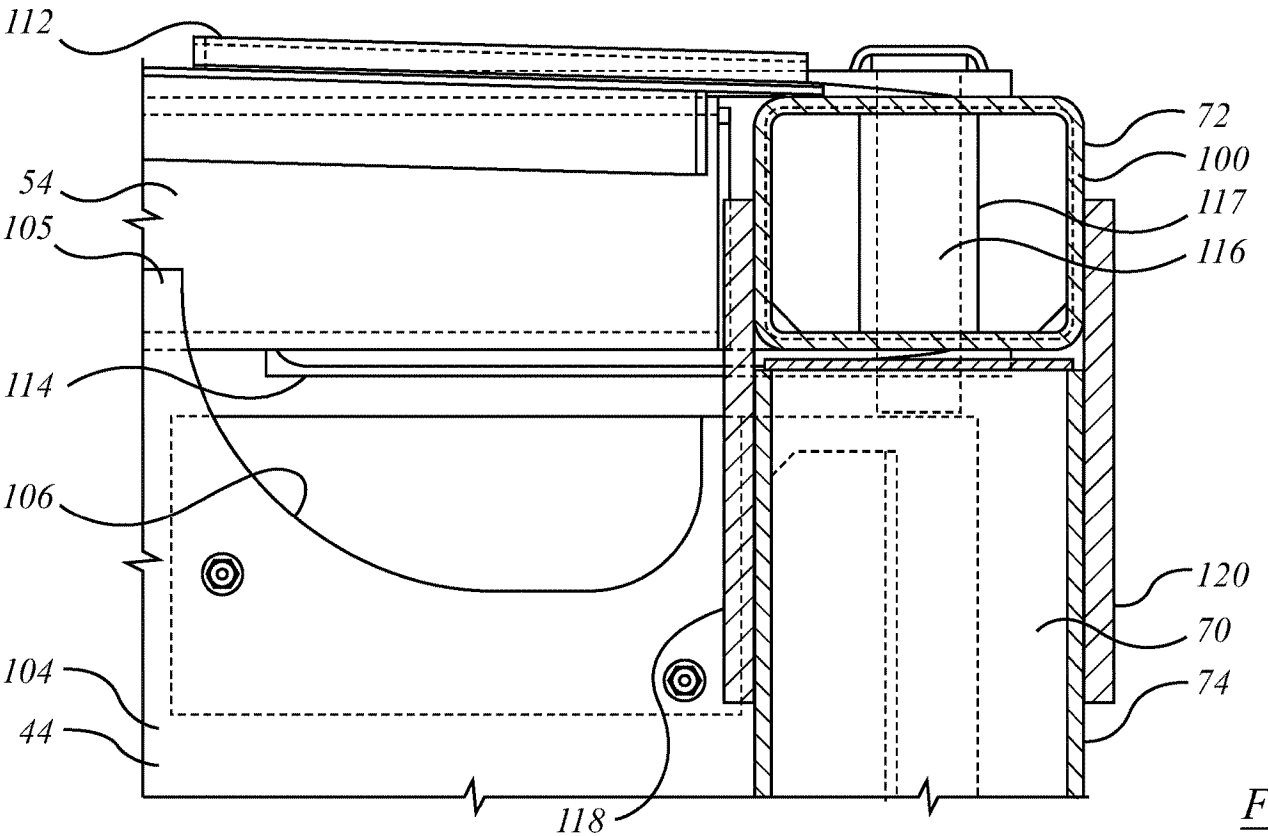
FIG. 4*b* shows a horizontal view through a section of the end door of the corner of the freight car of FIG. 4*a*, looking outboard.

In FIG. 3*c*, panel 132 has a set of downwardly depending peripheral edge flanges, or webs, 158 along the cross-wise edge, 160 along the end edges. Intermediate webs are indicated as 162. Former 130 also has internal cross-channel web member or reinforcements, or web separators, 164, that mate or overlap with webs 162, and outboard web separators 166. Former 130 may also have wear strips, or guard strips, or cushioning members or strips, identified as 180, such as may be made of nylon or steel, and such as may be free of sharp edges, and over which a membrane, such as a tarpaulin, may be drawn tight. These members may tend also to prevent a strap from sliding off the bow in the longitudinal direction.

Cleats 170, such as may have the form of angle irons 172, are mounted to top chords 54. Cleats 170 have a mating set of apertures 174 corresponding to apertures 150. When Former 130 is installed, respective pins 176 pass through corresponding ones of apertures 150 and 174, and are held in place with cotter pins 178. The outboard web 154 has corners, or ears 168 that extend laterally proud of the pin connection, such that any membrane formed over the ears may tend to be discouraged from catching upon the pins.

As may be noted, there is axial play, i.e., a tolerance of relative movement between the parts, in this connection. That is, at the engagement interfaces defined by parts 150, 174 and 176, the connection has a first degree of freedom in the lateral direction of the car body, while it is inhibited from motion in either the vertical or longitudinal directions. Similarly, at the forward or outboard margin of panel 132, the captured engagement relationship of margin or edge 136 between fingers 124 and beam member 100 inhibits motion in the vertical direction, while providing a degree of freedom of motion in the longitudinal direction.

When a tarp is installed, the ropes or straps of the tie-downs are secured to the outside of the car along the tie-down reefing bars, as at 98 (on the ends of the car) and 96 (on the sidewalls of the car).

When the railroad car is in operation, the top chords flex laterally. That motion is taken up in the permitted play in the pins-and-apertures. This may be contrasted with an all-welded structure, in which such lateral flexing motion might otherwise tend to impose substantial loads upon the tarp dome, possibly leading to its cracking or destruction.

Figure 6A:
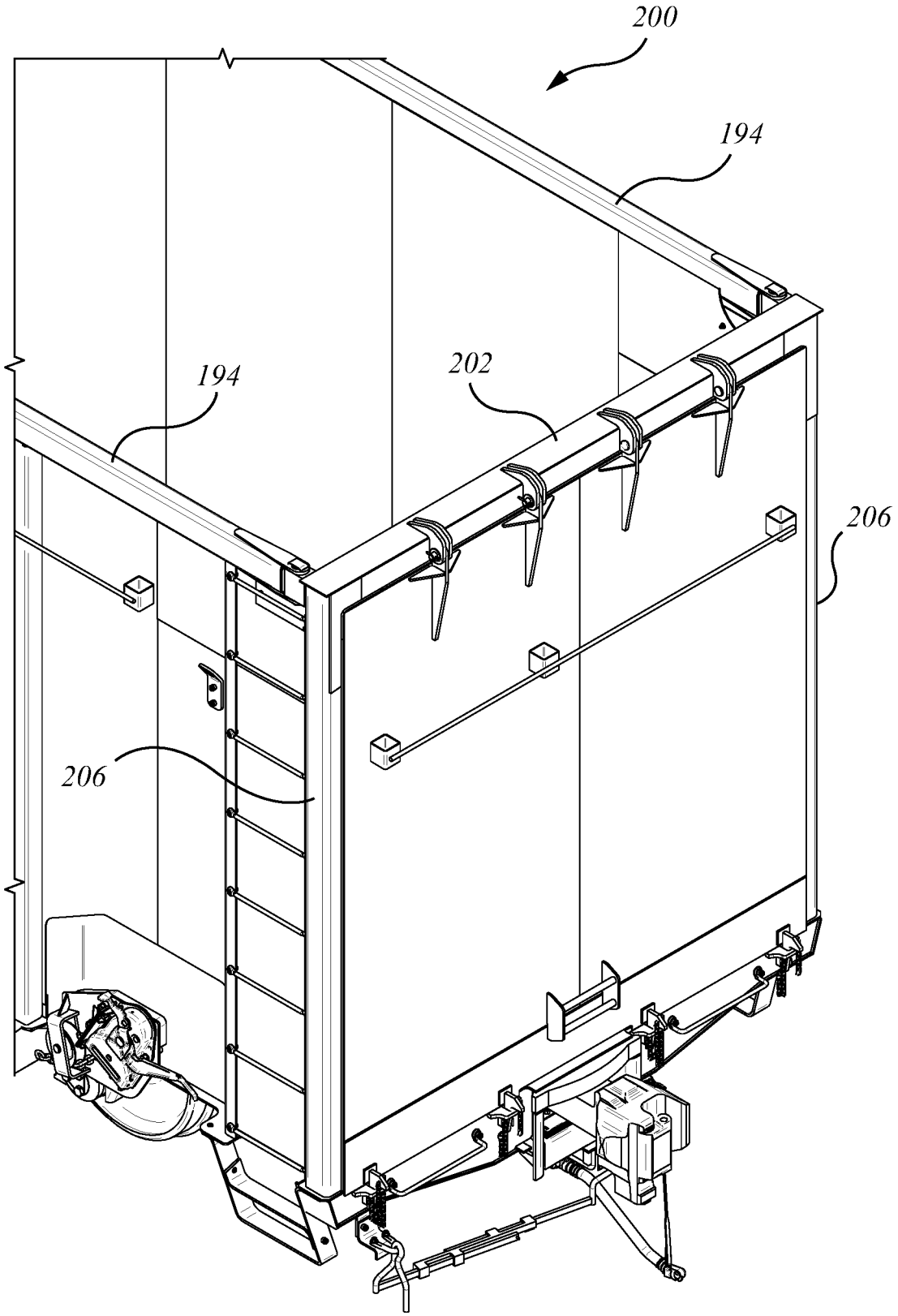
FIG. 6*a* shows an isometric view of an alternate embodiment of end door assembly to that of FIG. 2*a;*
Figure 6B:
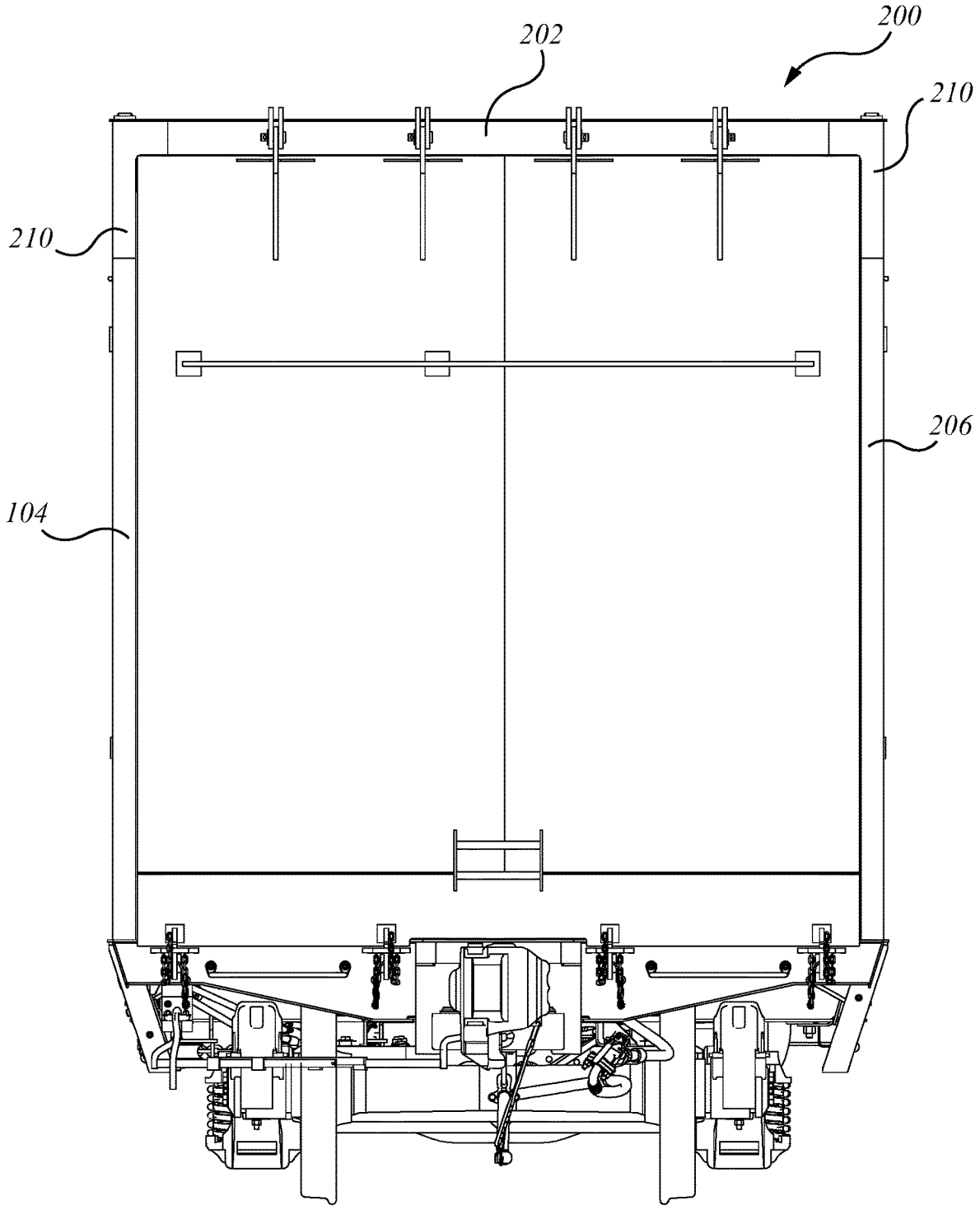
FIG. 6*b* shows an end view of the embodiment of FIG. 6*a;*
Figure 6C:
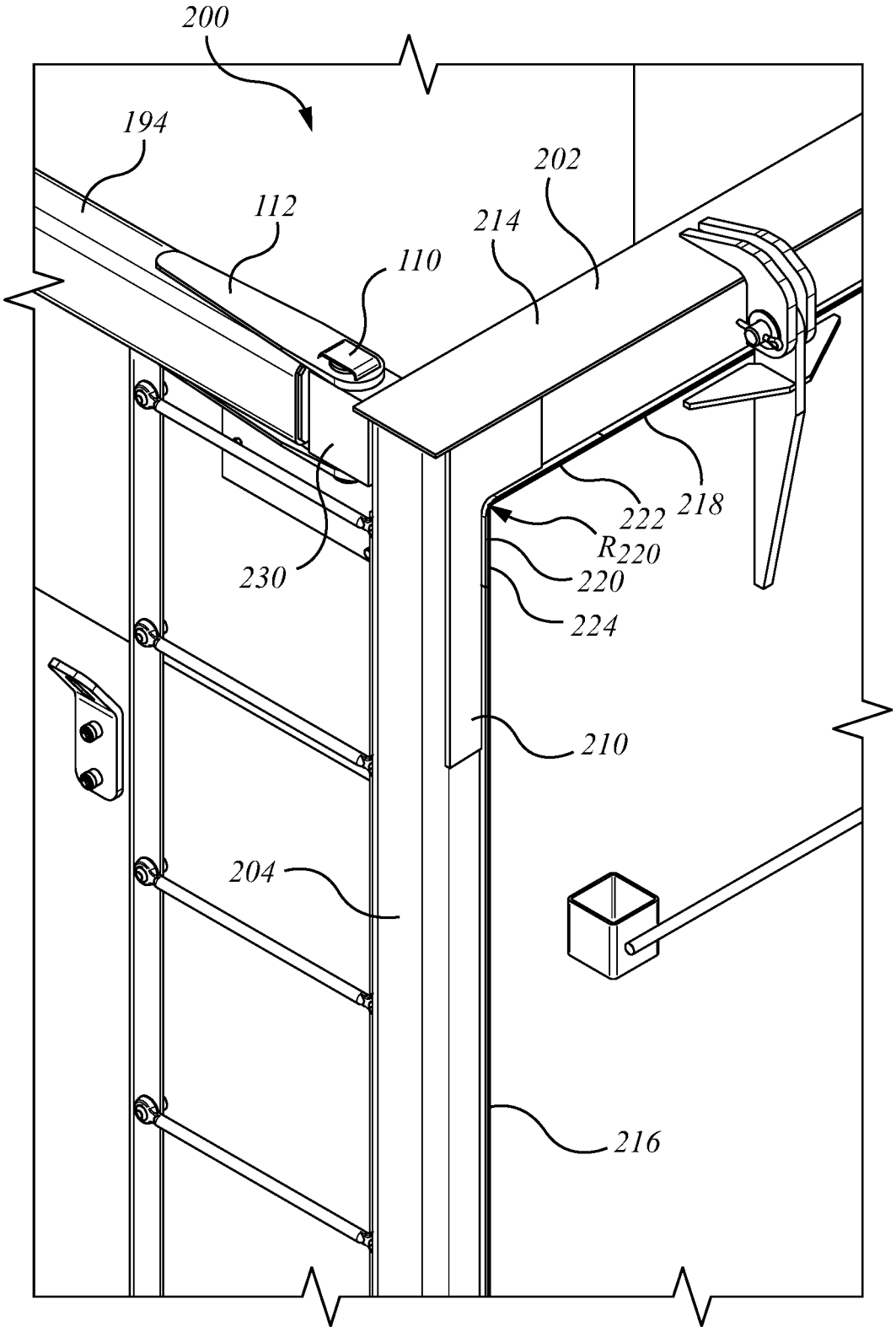
FIG. 6*c* shows an enlarged detail of FIG. 6*a;*
Figure 6D:
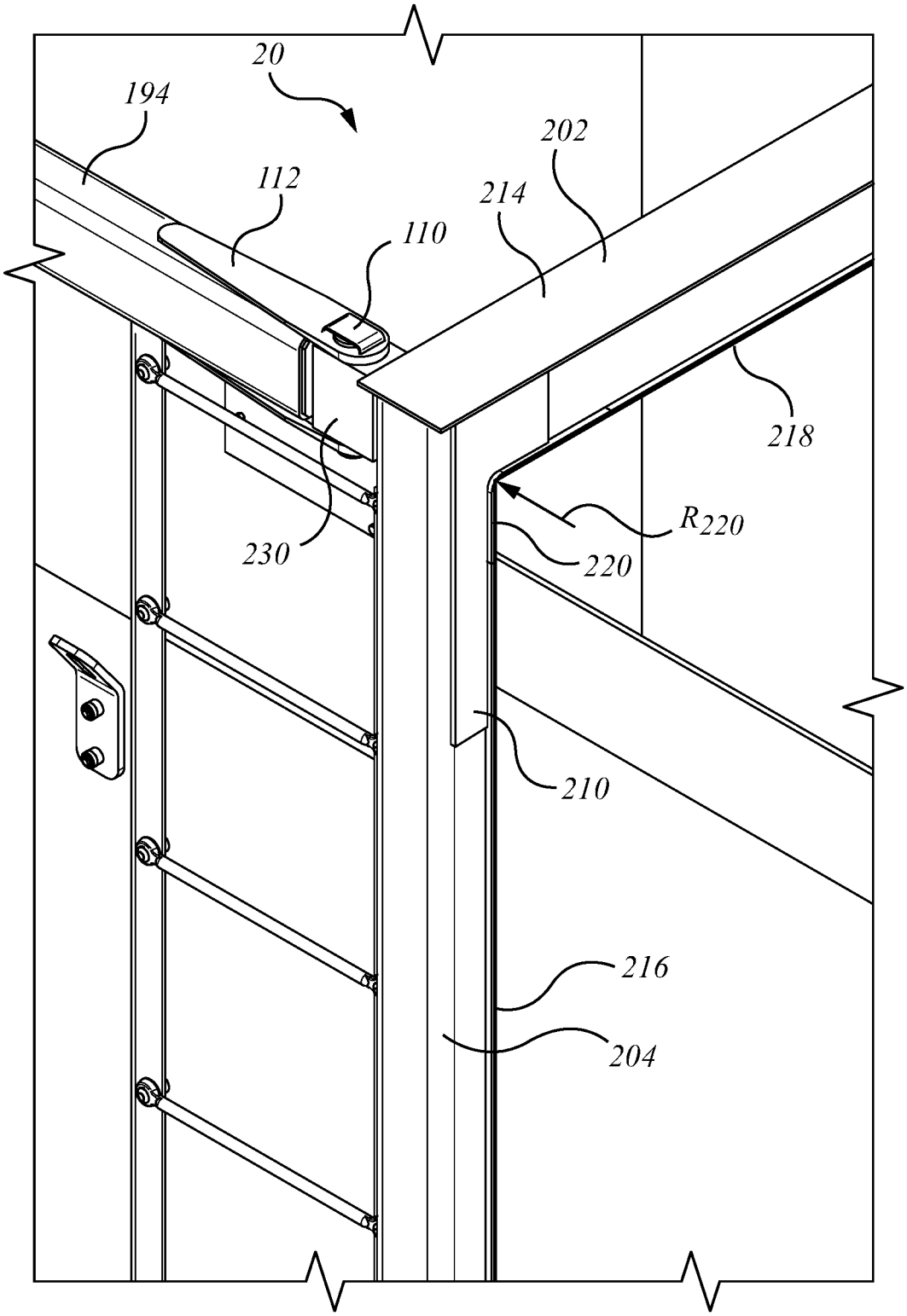
FIG. 6*d* shows a further enlarged detail of FIG. 6*c;*
Figure 6E:
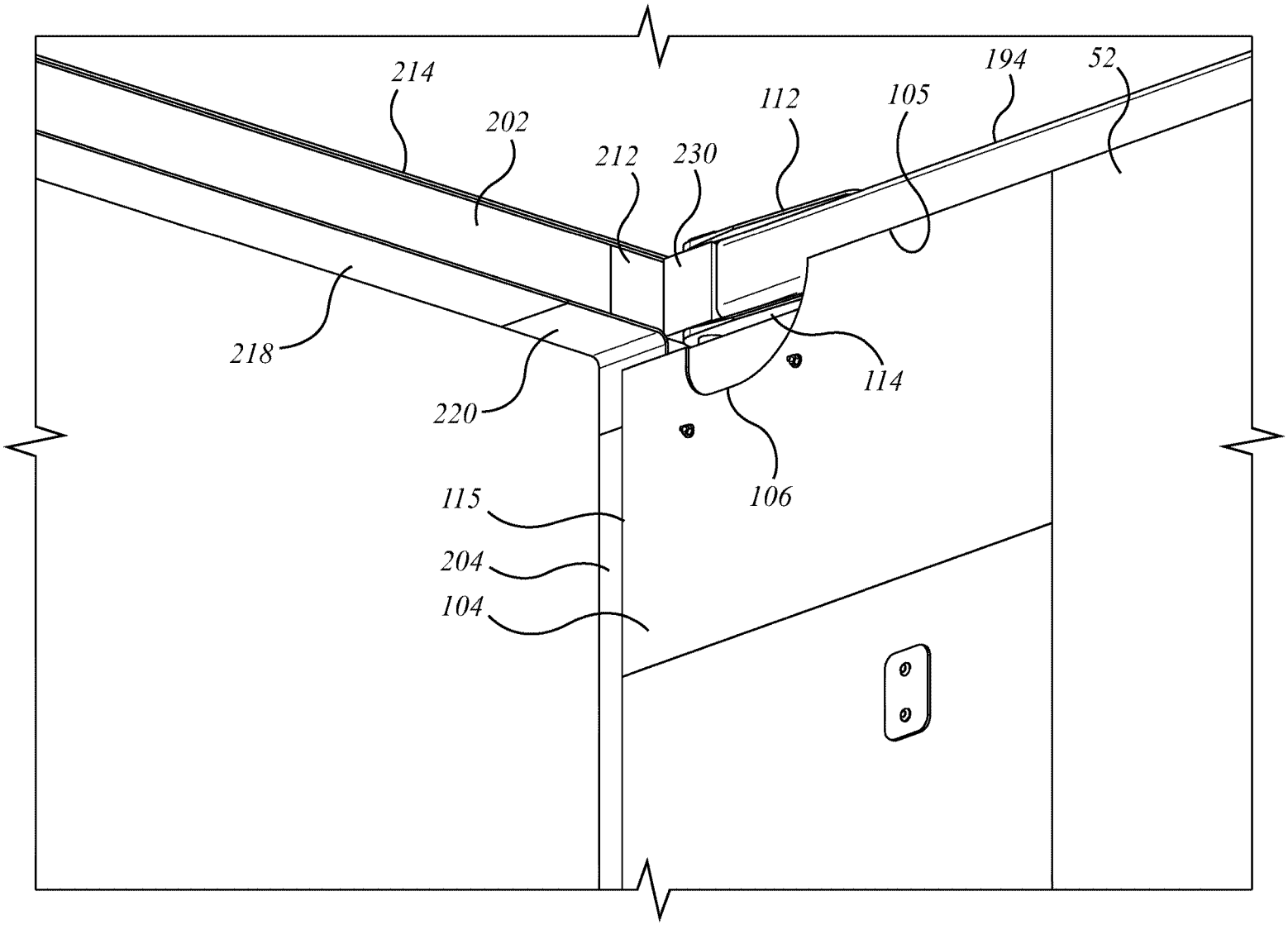
FIG. 6*e* shows an isometric view of the detail of FIG. 6*c* from inside and below, with the door removed.
Figure 6F:
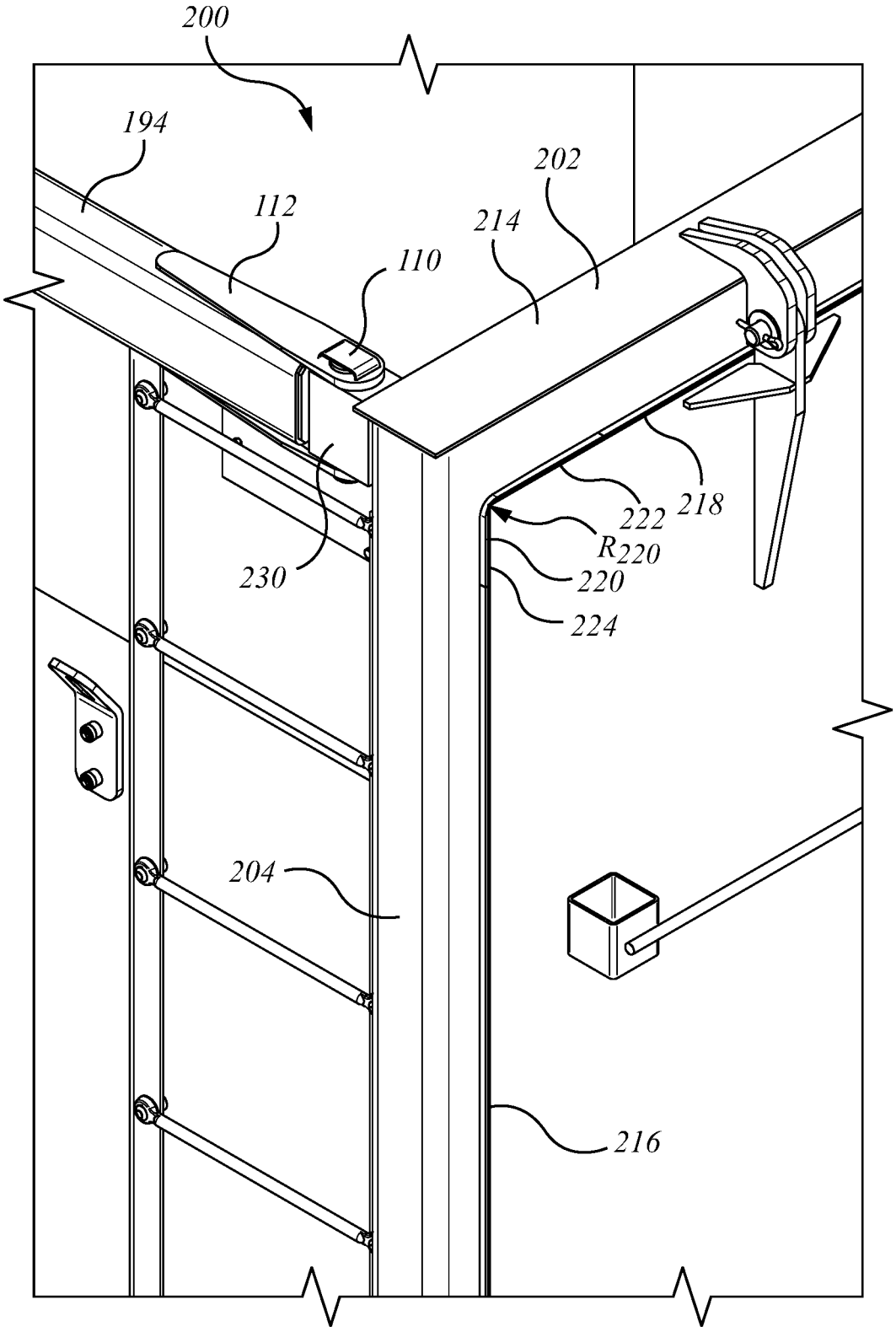
FIG. 6*f* shows an alternate embodiment of the detail of FIG. 6*c*.

The alternate embodiment of FIGS. 6*a*-6*e* is substantially similar to that described above. However, rather than employing the mechanically fastened gusset plates as before, the end frame of the car, 200, has a lateral cross-member 202 and upstanding side frame members 204, 206. Each side frame member 204, 206 is formed of a U-channel, oriented with toes inboard. Cross-member 202 may be a square or rectangular steel tube, or may be a U-shaped pressing, oriented with toes upward. The leg of the U-channel in the corner may be lengthened to extend along the headframe member to a butt-weld distant from the corner, i.e., so that there is not a weld in the corner itself. Outside and inside doublers having the form of elbows 210, 212 may be welded over the respective junctions of cross-member 202 and each side frame member 204, 206, lapping the joint so that, again, the structure does not depend on a weld located in the corner itself. In the alternate embodiment of FIG. 6*f*, doublers are not employed. Rather, the frame corner is formed as a continuous piece that does not have a seam in the corner. A top flange 214 is welded across the entire width of the assembly on top of cross-member 202, with ends extending to overlie, and close in, the tops of side frame members 204, 206. An inside door jamb flange 216 is welded across the toes of side frame members 204, 206. An inside doubler or flange 218 is welded to the underside of cross-member 202. Both flange 216 and flange 218 stop well short of the corner. A formed angle 220 has a first leg 222 and a second leg 224. First leg 222 runs horizontally and is welded to the underside of cross-member 202. The distant end of leg 222 abuts the end of flange 218. Second leg 224 runs vertically down, and is welded to, the inside of side frame member 204, 206. The distant end of leg 224 abuts the upper end of flange 216. The ends of legs 222 and 224 do not align with the ends of the arms of elbows 210, 212. Angle 220 has been formed on a radius, indicated at $R_{220}$ that matches the profile corner radius of elbows 210, 212. Angle 220 is thus a continuous flange extending through the corner connection. As may be understood, in this embodiment door 70 has rounded upper corners to conform to the radius of angle 220. The assembly so described defines a moment connection between the headframe member and the side frame members. As before, the assembly defines a prefabricated U-shape door frame, and, structurally, defines a spring that may tend to resist lateral parallelogram deflection. The various door hinge and tarpaulin dome cleats may be added, as above.

A stub or block or boss, 230, is welded to the interior web at the junction of the headframe member and the side frame member. It is provided with a pin connection bore, as before. Top chords 194 are as before, except that they have been shortened to an extent corresponding to the longitudinal extent of boss 230. The hinge members and pin are otherwise as described above. In this embodiment, the end posts, namely side frame members 204, 206 are in line with the remainder of posts 50 and 58, such that boss 230 is also in line with both members 204, 206 and with top chords 194.

In the embodiment of FIGS. 6*a*-6*e*, the assembly has an integrated post and header, where there is a continuously welded inside flange that wraps around the inside of the corner between the two members. This arrangement does not have a transverse weld joint at the interior corner of the connection, an area that may otherwise be susceptible to cracking due to the lack of a fixed end wall to provide shear strength in the plane of the door.

Gondolas with end doors that are able to be opened or otherwise removed, (such as woodchip gondolas) may have reduced lateral stiffness of the vertical portion of the end of the car as compared to gondola cars having solid end walls. Lateral forces on the sidewall at the end of the car then find their reaction at the base and top of the end post. The embodiments described above may tend to increase the load capacity and fatigue life of the top corner connection by removing welding in the highest stress location.

While not required to form the door frame assembly, in both of the embodiments described above, a pin-joint connection is used to tie into the side assembly top chord. This may tend to make the connection more like that of a fixed end gondola. It may also tend to reduce the probability of fatigue crack formation at the connection of the sidewall top chord to the end frame assembly by eliminating welding altogether in a high stress joint.

An additional element or feature of the car concerns the tarp dome on the end of the lading receptacle. The function of the tarp dome is to keep a tarp used over the lading from pooling in the corners of the car as well as giving a rigid structure for tightening ratchet straps against. The embodiment described above applies the tarp dome to the car by pin connections through angles welded to both top chords and retainers, or tabs, welded to the end wall header. These connections restrain the dome in respect of vertical motion, and restrict longitudinal motion relative to the side top chord, but allow the top chords to deflect laterally and the header to deflect longitudinally independent of the tarp dome. In a sense, the tarp dome is allowed to "float", or accommodate a certain amount of play, in these connections, where a welded connection might otherwise be prone to crack or rip. The header and the sidewall top chords are known to experience deflections when the car is loaded. The non-rigid connections may tend to prevent damage to the tarp dome, car structure, and the connection between them during the service life of the car.

These features may tend to reduce or to eliminate weld joints in areas that might otherwise be susceptible to cracking due to the stresses associated with a gondola that does not have fixed end walls. The door frame that is independent of the side assemblies allows the door and frame to be sub-assembled and applied to the car in one piece. Applying sides to a gondola with no fixed end walls may be difficult as there is no structure between the sides to press against for fit-up and welding. The door frames herein provide structure to aid in assembly. When applied prior to the application of the side assemblies, the pre-fabricated door frame may facilitate fitting of the sides on the car, as the side assemblies may be pressed against the door posts during fit-up and welding. This tends to simplify the process of door alignment to the posts, as well as improving the process of applying the sidewalls.

Various embodiments have been described in detail. Since changes in and or additions to the above-described examples may be made without departing from the nature, spirit or scope of the invention, the invention is not to be limited to those details but only in by a purposive construction of the claims as required by law.

We claim:

1. A railroad car comprising:

a car body mounted on railroad car trucks for rolling motion in a longitudinal direction along railroad tracks;

said car body having first and second sidewalls running length-wise therealong, each of said sidewalls having an upper margin;

said car body having first and second ends;

said car body having a lading receptacle defined between said first and second sidewalls and said first and second ends;

at least said first end including a lading discharge door assembly;

said lading discharge door assembly including a headframe member, and a door mounted below said headframe member, said door being movable between a closed position in which to discourage discharge of lading, and an open position in which to permit discharge of lading;

said headframe member being connected to said upper margins of said first and second sidewalls at motion tolerant connections, said motion tolerant connections having a degree of freedom accommodating lateral angular deflection of said upper margins of said first and second sidewalls.

2. The railroad car of claim 1 wherein said motion tolerant connections are pin-joint connections.

3. The railroad car of claim 1 wherein said upper margins of said first and second sidewalls each include a top chord, each said top chord having ends, said headframe member is connected to respective ends of said top chords, and said respective motion tolerant connections permit rotation about a vertical axis of said top chord ends relative to said end frame member.

4. The railroad car of claim 1 wherein said headframe member defines top chord deflection nodal points, and defines a fixed spacing therebetween.

5. The railroad car of claim 1 wherein said headframe member has a first end and a second end;

said lading discharge door assembly includes first and second side frame members, said first and second side frame members being connected to, and extending downwardly of, said first and second ends of said headframe member respectively, whereby said headframe member and said first and second side frame members co-operably define a downwardly opening U-shaped frame; and said headframe member and side frame members being secured to each other at moment connections whereby said U-shaped frame is resistant to lateral racking.

6. The railroad car of claim 5 wherein each said moment connection includes a non-welded gusset.

7. The railroad car of claim 5 wherein each said moment connection includes an inside flange and an outside flange, said inside and outside flanges having flange continuity through said connection.

8. The railroad car of claim 5 wherein said U-shaped frame is a prefabricated U-shaped frame, and is adjustable in the longitudinal direction of said railroad car on assembly.

9. The railroad car of claim 8 wherein said first and second sidewalls include sidewall sheets that overlap said first and second side frame members respectively.

10. The railroad car of claim 5 wherein said door is hingedly connected to said headframe member.

11. The railroad car of claim 10 wherein said assembly includes a door seal between said door and each of said first and second side frame members.

12. The railroad car of claim 1 wherein said car includes a tarpaulin dome.

13. The railroad car of claim 1 wherein first and second top chords are mounted along said uppermost margins of said first and second sidewalls; said car includes a tarpaulin dome, said tarpaulin dome has first and second mounting fittings by which said tarpaulin dome is secured to said first and second top chords at respective first and second tarpaulin dome connections, and at least one of said first and second tarpaulin dome connections is tolerant of lateral motion between said tarpaulin dome and the associated one of said first and second top chords.

14. The railroad car of claim 1 wherein:

said upper margins of said first and second sidewalls include, respectively, a first top chord and a second top chord;

said headframe member has a first end and a second end;

said first and second ends of said headframe member are connected to respective ends of said first and second top chords;

said respective motion tolerant connections are pin joint connections defining nodal points that permit rotation about a vertical axis of said top chord ends relative to said end frame member;

said lading discharge door assembly includes first and second side frame members, said first and second side frame members being connected to, and extending downwardly of, said first and second ends of said headframe member respectively, whereby said headframe member and said first and second side frame members co-operably define a downwardly opening U-shaped frame;

said headframe member and said side frame members being secured to each other at moment connections resistant to lateral racking of said U-shaped frame;

said moment connections include one of (a) a non-welded gusset; and (b) a pair of inside and outside flanges between said headframe member and said side frame members, each said inside flange being continuous between said headframe member and one of said side frame members;

said first and second sidewalls include sidewall sheets that overlap said first and second side frame members respectively;

said U-shaped frame is a prefabricated U-shaped frame, and is adjustable in the longitudinal direction of said railroad car on assembly;

said door is hingedly connected to said headframe member; and a door seal acts between said door and each of said first and second side frame members.

15. The railroad car of claim 14 wherein:

said car includes a tarpaulin dome;

said tarpaulin dome has first and second mounting fittings by which said tarpaulin dome is secured to said first and second top chords at respective first and second tarpaulin dome connections, and at least one of said first and second tarpaulin dome connections is tolerant of lateral motion of between said tarpaulin dome and the associated one of said first and second top chords.

16. A prefabricated end door assembly for an open top railroad freight car comprising:

a frame including a headframe member; a first side frame member; and a second side frame member;

said headframe member, first side frame member and second side frame member being assembled to form a downwardly opening U-shape, a doorway being defined inside said U-shape of said frame;

said headframe member having a first end and a second end;

said headframe member extending cross-wise between said first and second side frame members;

said first frame member being connected to said first end of said headframe member at a first moment connection;

said second frame member being connected to said second end of said headframe member at a second moment connection;

a first pin joint connection by which to secure said end door assembly to a first top chord of a railroad car sidewall; and a second pin joint connection by which to secure said end door assembly to a second top chord of a railroad car sidewall.

17. The prefabricated end door assembly of claim 16 wherein a door is mounted within said U-shape of said frame, said door having a door seal.

18. The prefabricated end door assembly of claim 16 wherein an outwardly opening door assembly is pivotally mounted to said headframe member.

19. The prefabricated end door assembly of claim 18 wherein a seal is mounted between said door and each of said first and second side frame members.

20. The prefabricated door assembly of claim 16 wherein said door has upper corners having one of (a) a chamfer; and (b) a radius.

21. The prefabricated end door assembly of claim 16 wherein each said moment connection includes at least a first gusset having a non-welded connection to at least one of said headframe and said first side frame.

22. The prefabricated end door assembly of claim 16 wherein each said moment connection includes an inboard gusset and an outboard gusset, said inboard gusset and said outboard gusset being secured by mechanical fasteners to said first end of said headframe member and to an upper end of said first side frame member.

23. The prefabricated end door assembly of claim 16 wherein said first moment connection includes an inner flange and an outer flange co-operably mounted to resist lateral racking of said assembly.

24. The prefabricated end door assembly of claim 16 wherein said first moment connection provides flange continuity between said first side frame member and said first end of said headframe member.

25. The prefabricated end door assembly of claim 16 wherein said first moment connection includes one of:

(a) an out-of-plane boss having an accommodation for a pin of a pin joint; and (b) a pin accommodation defined in said first end of said headframe member.

26. A prefabricated end door assembly for an open top railroad freight car comprising:

a frame including a headframe member; a first side frame member; and a second side frame member;

said headframe member, first side frame member and second side frame member being assembled to form a downwardly opening U-shape, a doorway being defined inside said U-shape of said frame;

said headframe member having a first end and a second end;

said headframe member extending cross-wise between said first and second side frame members;

said first frame member being connected to said first end of said headframe member at a first moment connection;

said second frame member being connected to said second end of said headframe member at a second moment connection;

a first pin joint connection by which to secure said end door assembly to a first top chord of a railroad car sidewall;

a second pin joint connection by which to secure said end door assembly to a second top chord of a railroad car sidewall; and at least one of (a) said first moment connection includes an inner flange and an outer flange co-operably mounted to resist lateral racking of said assembly; and (b) said first moment connection provides flange continuity between said first side frame member and said first end of said headframe member.

* * * * *